US006993270B2

(12) United States Patent
Yoshioka et al.

(10) Patent No.: US 6,993,270 B2
(45) Date of Patent: Jan. 31, 2006

(54) BELT MEMBER INCORPORATED IN IMAGE FORMING APPARATUS

(75) Inventors: Kenjiro Yoshioka, Nagano (JP); Kiyoteru Katsuki, Nagano (JP); Tomoe Aruga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 5 days.

(21) Appl. No.: 10/687,930

(22) Filed: Oct. 20, 2003

(65) Prior Publication Data

US 2004/0136750 A1 Jul. 15, 2004

(30) Foreign Application Priority Data

Oct. 18, 2002 (JP) ..... P2002-303956
Oct. 18, 2002 (JP) ..... P2002-303957
Oct. 18, 2002 (JP) ..... P2002-303958

(51) Int. Cl.
*G03G 15/00* (2006.01)
*G03G 15/16* (2006.01)
*G03G 15/20* (2006.01)

(52) U.S. Cl. ..... 399/162; 399/302; 399/308; 399/313; 399/329; 428/57; 474/253

(58) Field of Classification Search ..... 399/162, 399/302, 308, 303, 312, 313, 329, 320; 428/57, 428/58, 59, 60, 61, 62; 474/253, 254
See application file for complete search history.

(56) References Cited

U.S. PATENT DOCUMENTS 4,311,756 A * 1/1982 Brooksbank ..... 428/57 X
5,321,480 A * 6/1994 Merle et al. ..... 399/329
5,489,972 A * 2/1996 Shuster et al. ..... 399/313
5,697,030 A * 12/1997 Hayashi et al. ..... 399/312 X
5,951,441 A * 9/1999 Dalebout et al. ..... 474/253 X
6,009,290 A * 12/1999 Mochida ..... 399/162
6,181,889 B1 * 1/2001 Hayano et al. ..... 399/162 X
6,312,778 B1 * 11/2001 Sandell ..... 428/57
6,618,570 B2 * 9/2003 Yuan et al. ..... 399/303
2002/0170806 A1 * 11/2002 Engle et al. ..... 198/844.2

FOREIGN PATENT DOCUMENTS

JP 06-043768 A * 2/1994
JP 8-187773 A 7/1996
JP 11-212422 A * 8/1999
JP 2000-330422 A * 11/2000
JP 2001-066907 A * 3/2001
JP 2001-215845 A * 8/2001
JP 2002-082540 A * 3/2002
JP 2002-091194 A * 3/2002

* cited by examiner

*Primary Examiner*—Sophia S. Chen
(74) *Attorney, Agent, or Firm*—Sughrue Mion, PLLC

(57) ABSTRACT

A belt member is formed with a seam portion by overlapping and adhering both longitudinal end portions thereof to constitute an endless belt stretched and circulated by a rotative, first stretching member and a second stretching member. A length of the seam portion is no less than a length between a first point at which the endless belt is separated from one of the first stretching member and the second stretching member and a second point at which the endless belt is brought into contact with the other one of the first stretching member and the second stretching member.

17 Claims, 15 Drawing Sheets

BELT MEMBER INCORPORATED IN IMAGE FORMING APPARATUS

BACKGROUND OF THE INVENTION

The present invention relates to a belt member formed with a seam portion and incorporated in an image forming apparatus.

In an image forming apparatus, there is used a belt-shaped film such as a photosensitive film and an image fixing film. For example, Japanese Patent Publication No. 8-187773A discloses an image fixing film formed with an overlapped portion at which longitudinal ends of the film are overlapped. It is disclosed to form a seamed endless belt by bonding the overlapped portion (hereinafter, referred to as seam portion).

The seam portion is formed by a length shorter than a total length of the endless belt. When the seamed endless belt is supported between stretching members and driven to circulate, since the length of the seam portion is extremely shorter than a distance between the stretching members, there poses a problem that when the seamed endless belt is repeatedly used, a damage is caused such that the seam portion is exfoliated or the belt is cut.

FIGS. 31 and 32 are sectional views showing a constitution of a film 70 described in the above publication. In FIG. 31, numerals 71 and 72 designate longitudinal ends of a substrate, and a seam portion 72 is formed by adhering the overlapped ends. A thickness of the substrate at the seam portion becomes Wa to bring about a stepped difference.

There is a case in which the substrate having a stepped difference cannot be run smoothly or a case in which the substrate causes to produce damage. Therefore, as shown by FIG. 32, a flattened portion 73 is formed at the seam portion by pressing to flatten the stepped difference by applying heat and pressure.

According to the above constitution, only one sheet of the substrate is constituted except the seam portion and therefore, there is a case in which the strength is deficient when the film is used as a belt member of a photosensitive film, an image fixing film or the like in an image forming apparatus. Therefore, a problem of destructing the belt member is posed. Further, there poses a problem that the large stepped difference of the belt member in running impinges on other elements of the apparatus, so that the belt member is damaged.

Further, as shown by FIG. 32, since the seam portion is pressed to flatten to constitute the flattened portion, a density of the flattened portion becomes approximately twice as much as that of other portion. Therefore, when such a substrate is used as an image fixing film, transfer of temperature to a recording medium is deteriorated at the portion to thereby pose a problem that a failure in fixing is brought about.

SUMMARY OF THE INVENTION

It is therefore an object of the invention to provide a belt member capable of preventing a seam portion from being damaged.

It is also an object of the invention to provide a belt member capable of increasing a strength of the seam portion and preventing a fixing failure from being occurred.

It is also an object of the invention to provide a fixing device or an image forming apparatus incorporating such a belt member.

In order to achieve the above objects, according to the invention, there is provided a belt member, comprising a seam portion formed by overlapping and adhering both longitudinal end portions thereof to constitute an endless belt stretched and circulated by a rotative, first stretching member and a second stretching member, wherein a length of the seam portion is no less than a length between a first point at which the endless belt is separated from one of the first stretching member and the second stretching member and a second point at which the endless belt is brought into contact with the other one of the first stretching member and the second stretching member.

In this configuration, shear force exerting to the seam portion can be reduced so that the service life of the endless belt is prolonged.

According to the invention, there is also provided an image forming apparatus, comprising:

the above belt member;

a photosensitive member, operable to support a toner image thereon; and a transfer member, operable to transfer the toner image from the photosensitive member onto a recording medium transported by the belt member.

In this case, it is possible to prevent the seam portion of the endless belt used in the transfer operation from being damaged.

According to the invention, there is also provided an image forming apparatus, comprising:

the above belt member;

a photosensitive member, operable to support a toner image thereon;

a primary transfer device, operable to transfer a toner image from the photosensitive member onto the belt member; and a secondary transfer device, operable to transfer the toner image from the belt member onto a recoding medium.

In this case, it is possible to prevent the seam portion of the endless belt used in the intermediate transfer operation from being damaged.

Here, it is preferable that the image forming apparatus further comprises a third stretching member and fourth stretching member which are arranged such that a circulating path of the belt member is made trapezoidal. In this case, the endless belt can be circulated smoothly.

According to the invention, there is also provided an image forming apparatus, comprising:

the above belt member;

a heat generator, provided with the first stretching member; and a fixing member, arranged so as to abut against the first stretching member through the belt member, so that a toner image formed on a recording medium is fixed thereon when the recording medium is placed at a nip portion between the fixing member and the belt member.

In this case, it is possible to prevent the seam portion of the endless belt used in the fixing operation from being damaged.

Here, it is preferable that the image forming apparatus further comprises a third stretching member and fourth stretching member which are arranged such that a circulating path of the belt member is made trapezoidal. In this case, the endless belt can be circulated smoothly.

It is also preferable that the image forming apparatus further comprises:

a photo sensitive member, operable to support a toner image thereon; and a transfer member, operable to transfer the toner image from the photosensitive member onto a recording medium which is to be transported to the nip position.

Alternatively, it is preferable that the image forming apparatus further comprises:

a photosensitive member, operable to support a toner image thereon;

an intermediate transfer member;

a primary transfer device, operable to transfer a toner image from the photosensitive member onto the intermediate transfer member; and a secondary transfer device, operable to transfer the toner image from the intermediate transfer member onto a recoding medium which is to be transported to the nip portion.

According to the invention, there is also provided an image forming apparatus, comprising:

the above belt member; and a fixing member, provided with a heat generator and arranged so as to abut against the first stretching member through the belt member, so that a toner image formed on a recording medium is fixed thereon when the recording medium is placed at a nip portion between the fixing member and the belt member.

Here, it is preferable that the image forming apparatus further comprises:

a photo sensitive member, operable to support a toner image thereon; and a transfer member, operable to transfer the toner image from the photosensitive member onto a recording medium which is to be transported to the nip position.

Alternatively, it is preferable that the image forming apparatus further comprises:

a photosensitive member, operable to support a toner image thereon;

an intermediate transfer member;

a primary transfer device, operable to transfer a toner image from the photosensitive member onto the intermediate transfer member; and a secondary transfer device, operable to transfer the toner image from the intermediate transfer member onto a recoding medium which is to be transported to the nip portion.

It is also preferable that the second stretching member has a semiannular shape. In this case, the product cost can be reduced.

Preferably, the belt member is wound by a plurality of turns so that the length of the seam portion is made no less than a circumference of the endless belt.

In this configuration, sufficient strength can be assigned to the belt member while reducing the stepped difference at the seam portion. Therefore, it is possible to prevent the endless belt being damaged.

Here, it is preferable that the belt member is formed with a stepped portion through which both longitudinal ends of the belt member oppose to each other in a circumferential direction of the endless belt.

In this case, the thickness of the endless belt can be entirely uniformed. The stepped portion can be formed by applying heat and pressure.

According to the invention, there is also provided an image forming apparatus, comprising:

a rotative, first stretching member;

a second stretching member;

a belt member, comprising a seam portion formed by overlapping and adhering both longitudinal end portions thereof to constitute an endless belt stretched and circulated by the first stretching member and the second stretching member;

a fixing member, provided with a heat generator and arranged so as to abut against the first stretching member and the second stretching member through the belt member, so that a toner image formed on a recording medium is fixed thereon when the recording medium is placed at a nip portion between the fixing member and the belt member;

wherein a length of the seam portion is no less than a length between a first point at which the fixing member is abutted against the first stretching member through the belt member and a second point at which the fixing member is abutted against the second stretching member through the belt member.

In this configuration, shear force exerting to the seam portion can be reduced so that the service life of the endless belt is prolonged.

Here, it is preferable that the second stretching member has a semiannular shape. In this case, the product cost can be reduced.

It is also preferable that the image forming apparatus further comprises:

a photo sensitive member, operable to support a toner image thereon; and a transfer member, operable to transfer the toner image from the photosensitive member onto a recording medium which is to be transported to the nip position.

Alternatively, it is preferable that the image forming apparatus further comprises:

a photosensitive member, operable to support a toner image thereon;

an intermediate transfer member;

a primary transfer device, operable to transfer a toner image from the photosensitive member onto the intermediate transfer member; and a secondary transfer device, operable to transfer the toner image from the intermediate transfer member onto a recoding medium which is to be transported to the nip portion.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below with reference to the accompanying drawings.

Figure 1:
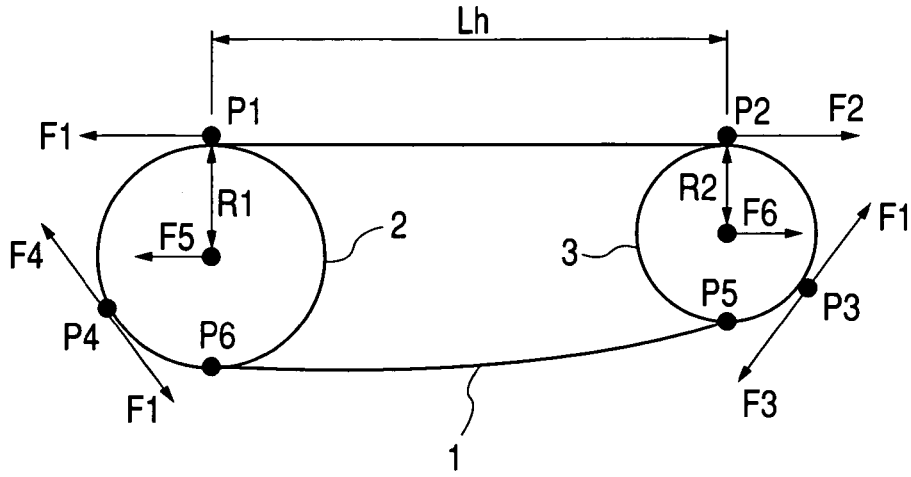
FIG. 1 is an explanatory view showing a configuration in which an endless belt is stretched.

FIG. 1 shows a configuration in which an endless belt 1 is stretched between a drive stretching member 2 and a stretching member 3 and circulated by a drive force of the drive stretching member 2.

A point P1 at which the endless belt 1 starts contacting with the drive stretching member 2 is exerted with a stretching force F1 of a total of a tension force F5(N) and a force by driving to rotate the driving stretch member 2 by a torque T (N·m). Here, T1=(T/R1)+F5 (N). Incidentally, notation R1 designates a diameter of moving the drive stretching member 2. Further, a point P2 at which the endless belt 1 starts separating from the stretching member 3 is exerted with a reaction force F2. Here, in order to move to rotate the endless belt at equal velocity, F2=F1=(T/R2)+F6 (N). Incidentally, notation R2 designates a diameter of moving the stretching member 3 and notation F6 designates a tension reaction force.

Further, the reaction force F2 is constituted by a friction force exerted to the endless belt 1 by the stretching member 3, or a friction torque of the stretching member 3, or an axially supporting force or a total of these. Between the point P1 and the point P2, the endless belt 1 is stretched by the stretching force F1 and the reaction force F2 in opposed directions. Meanwhile, at a point P3 or a point P4 of portions of the endless belt 1 in contact with the stretching member 3 or the drive stretching member 2, the stretching force F1 and a friction force F3 which the endless belt 1 receives from the stretching member 3 (hereinafter, the friction force generally designates a resistance force with respect to a force including static friction, dynamic friction, a friction torque of the belt 1 and the drive stretching member 2 or the stretching member 3) are canceled by each other. Further, the stretching force F1 and a friction force F4 received from the driving stretch member 2 are canceled by each other and therefore, a force of stretching the endless belt is smaller than the stretching force F1.

Similarly, at a point P5 at which the endless belt 1 starts contacting with the stretching member 3, the stretching force F1 and the friction force F3 are canceled by each other. Further, also at the point P6 at which the endless belt 1 starts separating from the drive stretching member 2, the stretching force F1 and the friction force F4 are canceled by each other. Therefore, a force of stretching the endless belt 1 is smaller than the stretching force F1. Therefore, between the point P5 and the point P6, the force of pulling the endless belt 1 is smaller than the stretching force F1.

Figure 2:
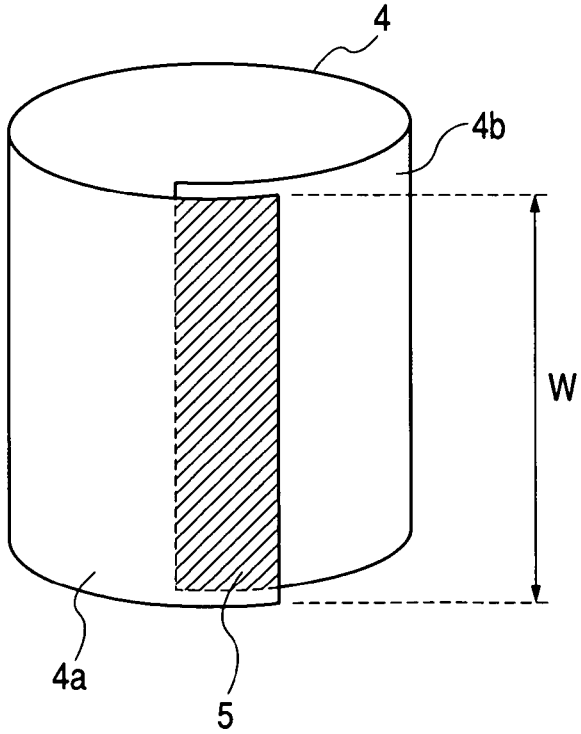
FIG. 2 is an explanatory view of a seam portion of the endless belt.

Next, an explanation will be given of equilibrium of force of a seamed endless belt. In FIG. 2, numeral 4 designates a film, numeral 5 designates a seam portion overlapping both longitudinal end portions of the film 4 so that the endless belt is formed by the film 4. A film on an upper side of the seam portion 5 is designated by notation 4*a* and a film on a lower side thereof is designated by notation 4*b*.

Figure 3:
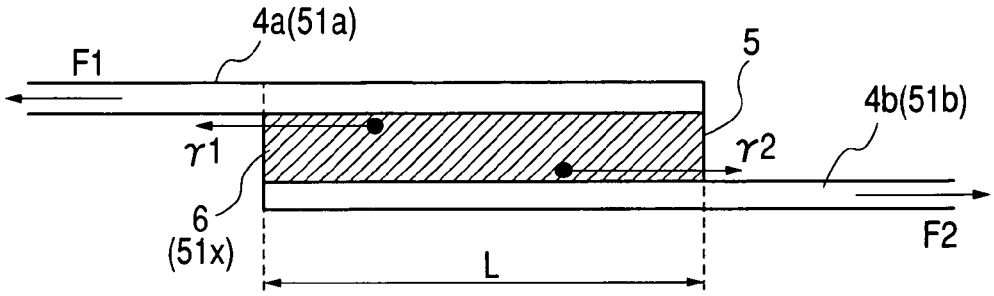
FIG. 3 is a diagram for explaining forces exerting to the seam portion.

FIG. 3 is a schematic view showing forces exerted to the seam portion 5 when the seam portion 5 of FIG. 2 is disposed between the point P1 of the drive stretching member 2 and the point P2 of the stretching member 3. In FIG. 3, the seam portion 5 of the endless belt is coated with an adhering material to form an adhering layer 6. The adhering layer 6 is exerted with a shear force γ1 by the stretching force F1 and a shear force γ2 by the reaction force F2.

Here, when a length of the seam portion 5 is designated by notation L(m) and a width of the belt (width of adhering layer) is designated by notation W(m), the following equation of γ1=F1/(L·W)=F2/(L·W)=γ2(N/m) is established. It is known from the this equation that the shear force γ1 (γ2) is reduced in an inverse proportion to the length L of the seam portion.

Figure 4:
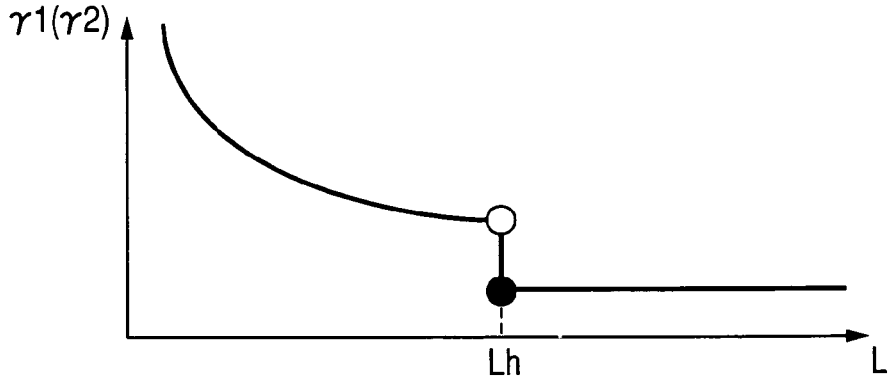
FIG. 4 is a diagram for explaining a relationship between a length of the seam portion and shear force exerting thereto.

FIG. 4 is a diagram showing a relationship between the length L of the seam portion 5 and the shear force γ1 (γ2). As shown, the shear force γ1 (γ2) is reduced in the inverse proportion of the length L of the seam portion. Further, at L>Lh, the shear force γ1 (γ2) becomes constant.

It appears that the shear force γ1 (γ2) exerted to the adhering layer 6 can be minimized by making the length L of the seam portion 5 equal to or larger than a distance Lh between the point P1 and the point P2. Further, when the distance between the point P1 and the point P2 of FIG. 1 is set to Lh (m), that is, when L=Lh, the stretching force F1 and the reaction force F2 are reduced by the friction forces F4 and F3 of the drive stretching member 2 and the stretching member 3. Therefore, also the shear force γ1 (γ2) is reduced.

Figure 5:
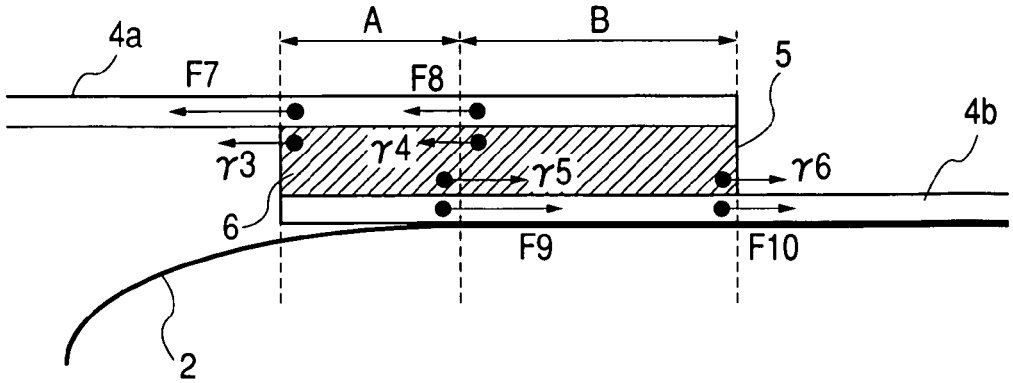
FIG. 5 is a diagram for explaining forces exerting to the seam portion which is brought into contact with a drive stretching member shown in FIG. 1.

Next, an explanation will be given of forces exerted to the seam portion 5 when the seam portion 5 is disposed between the point P1 and the point P2 and is brought into contact with the drive stretching member 2. In FIG. 5, a portion A is a portion at which the seam portion 5 is not brought into contact with the drive stretching member 2 and a portion B is a portion at which the seam portion 5 is brought into contact with the driving stretch member 2. At the portion A, the adhering layer 6 is exerted with a shear force γ3 by a stretching force F7 and a shear force γ5 by a reaction force F9. At the portion B, the adhering layer 6 is exerted with a shear force γ4 by a stretching force F8 and a shear force γ6 by a reaction force F10.

Further, a relationship between the stretching forces F7 and F8 becomes F8<F7 by the friction force received from the drive stretching member 2. Further, a relationship between the reaction forces F9 and F10 becomes F10<F9. Thereby, relationships among the stretching force and the reaction force and the shear forces in FIG. 3 become F7+F8<F1, γ3+γ4<γ1, F9+F10<F2 and γ5+γ6<γ2. Therefore, when a portion of the seam portion 5 is brought into contact with the drive stretching member 2, the shear forces exerted to a total of the adhering layer 6 becomes smaller than γ1 and γ2 of FIG. 3.

Therefore, the shear force γ1 (γ2) exerted to the adhering layer 6 can be minimized by making the length L of the seam portion 5 equal to or larger than the distance Lh between the point P1 and the point P2. Further, the shear force γ1 (γ2) exerted to the adhering layer 6 can be minimized whenever at least a portion of the seam portion 5 is disposed between the point P1 and the point P2.

Figure 6:
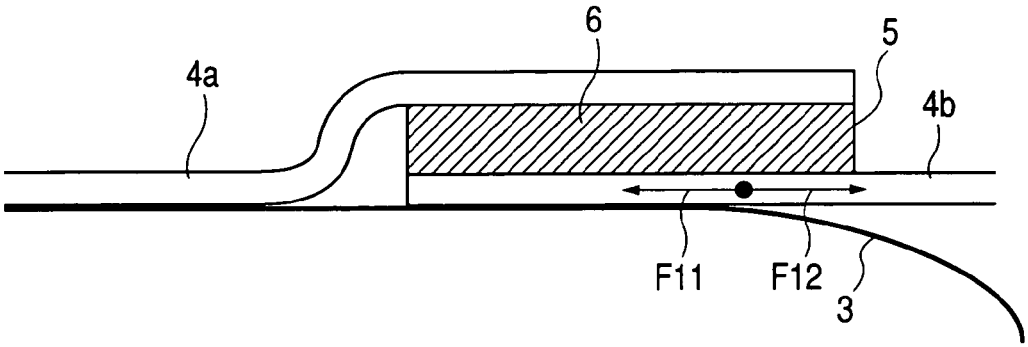
FIG. 6 is a diagram for explaining forces exerting to the seam portion which is brought into contact with a stretching member shown in FIG. 1.

Next, an explanation will be given of forces exerting to the seam portion 5 when the seam portion is disposed between the point P1 and the point P2 and is brought into contact with the stretching member 3. In FIG. 6, at the belt member 4*b* below the adhering layer 6, a stretching force F11 and a reaction force F12 are canceled by each other and therefore, a shear force applied to the adhering layer 6 becomes null. Further, the stretching force F11 is equal to the stretching force F1 of FIG. 1 and the reaction force F12 is equal to the reaction force F2 of FIG. 1.

Further, an explanation will be given of a case in which a layer upward from and a layer downward from the seam portion 5 of the endless belt are reversed in FIGS. 5 and 6. When a way of winding the film 4 is reverse to that of the example of FIG. 2, the drive stretching member 2 in FIG. 5 is replaced with the stretching member 3. Further, by replacing the stretching member 3 in FIG. 6 with the drive stretching member 2, forces exerted to the seam portion 5 of the endless belt can be explained similar to FIGS. 5 and 6, as mentioned above.

In this way, the endless belt according to the invention can minimize the shear force exerted to the seam portion 5 as shown by FIG. 4, so that the lifetime thereof can be prolonged. The endless belt can be used as a belt member for a photosensitive film, an image fixing film or the like in an image forming apparatus as mentioned later.

As a first embodiment, an explanation will be given of an example of applying a seamed endless belt according to the invention as a photosensitive film for an image carrier.

i) A substrate is constituted by a film of polyester resin having a thickness of 50 μm, a width of 340 mm and a length of 234 mm. Otherwise, polycarbonate or the like can be used as the substrate.

ii) A binder resin of polymethylmetacrylate is dissolved to toluene. Next, a conductive coating prepared by dispersing carbon black thereto is coated on a surface of the film (extrusion coater method) and dried to form a conductive layer having a thickness of 25 μm. Other than forming the conductive layer as described above, the conductive layer may be formed by vapor-depositing aluminum by 1000 Å.

iii) Copolymer nylon (nylon 6 or nylon 66 or nylon 12) dissolved in butanol is coated on the conductive layer formed as described above (extrusion coater method) and dried to form an under coating layer having a thickness of 1 μm.

iv) Dyan blue (kind of azo pigment) as a charge generating substance and polycarbonate resin as a binder resin are dissolved in n-butylamine to thereby prepare a coating solution of a charge generating layer. As a charge generating substance, sudan red, disazo pigment, quinone pigment, phthalocyanine pigment, pyrylium salt, or azulenium salt can be used. Further, as a binder resin, polysteyrene, polymethacrylate ester, polyester, or cellulose ester can be used. Further, as a solvent, diethylamine, ethylenediamine or acetone can be used.

v) The above-described coating solution is coated on the under coating layer (extrusion coater method) and dried to thereby form a charge generating layer having a thickness of 0.81 μm.

vi) Hydrazone compound as a charge transporting substance and polycarbonate resin as a binder resin are dissolved in n-butylamine to thereby prepare a coating solution of a charge transporting layer. As a charge coating substance, a compound including a polycyclic aromatic compound of anthracene, pyrene or the like at a principal chain or a side chain thereof, or a compound having a skeleton of nitrogen including cycle compound of indole, carbazole or the like can be used. Further, as a binder resin, polystyrene, polymethacrylate ester, polyester, cellulose ester can be used. Further, as a solvent, diethylamine, ethylenediamine, or acetone can be used.

vii) The above-described coating solution is coated on the charge generating layer (extrusion coater method) and dried to thereby form a charge transporting layer having a thickness of 17 μm.

Figure 7:
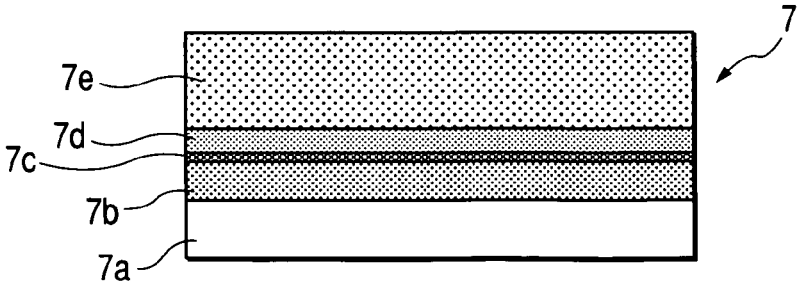
FIG. 7 is a diagram for explaining the constitution of a photosensitive film.

FIG. 7 is a schematic sectional view of a photosensitive film 7 formed by the above-described steps of i) through vii). In this figure, notation 7*a* designates a substrate comprised of a polyester resin film, notation 7*b* designates a conductive layer, notation 7*c* designates an under coating layer, notation 7*d* designates a charge generating layer and notation 7*e* designates a charge transporting layer. Both longitudinal ends of the photosensitive film 7 formed in this way are overlapped so as to form an overlapped portion. The overlapped portion is welded by ultrasonic welding to thereby form a seam portion.

Figure 8:
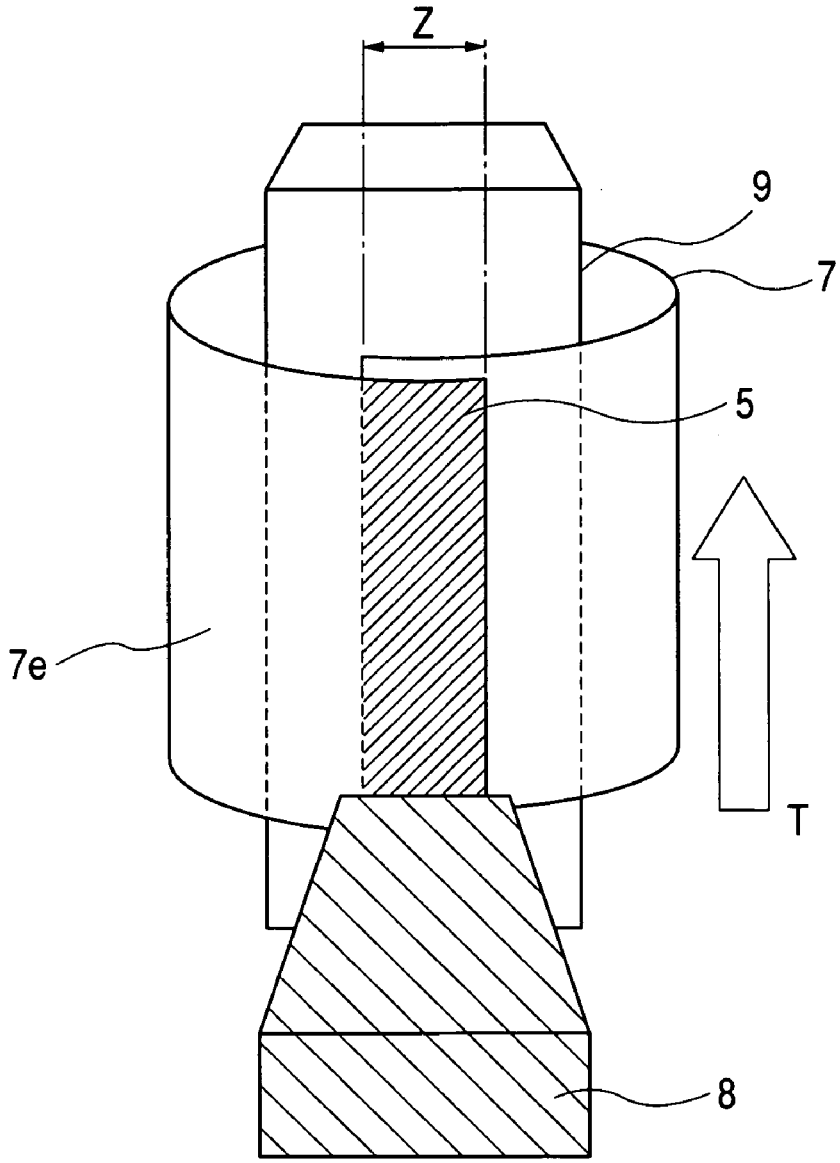
FIG. 8 is an explanatory view showing ultrasonic welding for manufacturing the endless belt.

When the ultrasonic welding is performed, as shown in FIG. 8, the charge transporting layer 7*e* is arranged to dispose on an outer side of the photosensitive film 7.

The overlapped portion of the photosensitive film 7 is held at a welding table 9 of an ultrasonic welder and a horn 8 is brought into contact thereon by pressing force of 50 kgf/cm$^2$. Further, the horn 8 is moved at a velocity of 30 mm/min in a direction of an arrow T while applying an ultrasonic wave having a frequency of 20 kHz and an amplitude of 20 μm. As a result, the seam portion 5 is formed by welding the overlapped portion by ultrasonic welding. A welding method by heat and pressure or an adhering method by an adhering agent can be used instead of using the ultrasonic welder. A width Z on the seam portion is 55 mm and a diameter of the formed seamed photosensitive film is ϕ60 mm.

Figure 9:
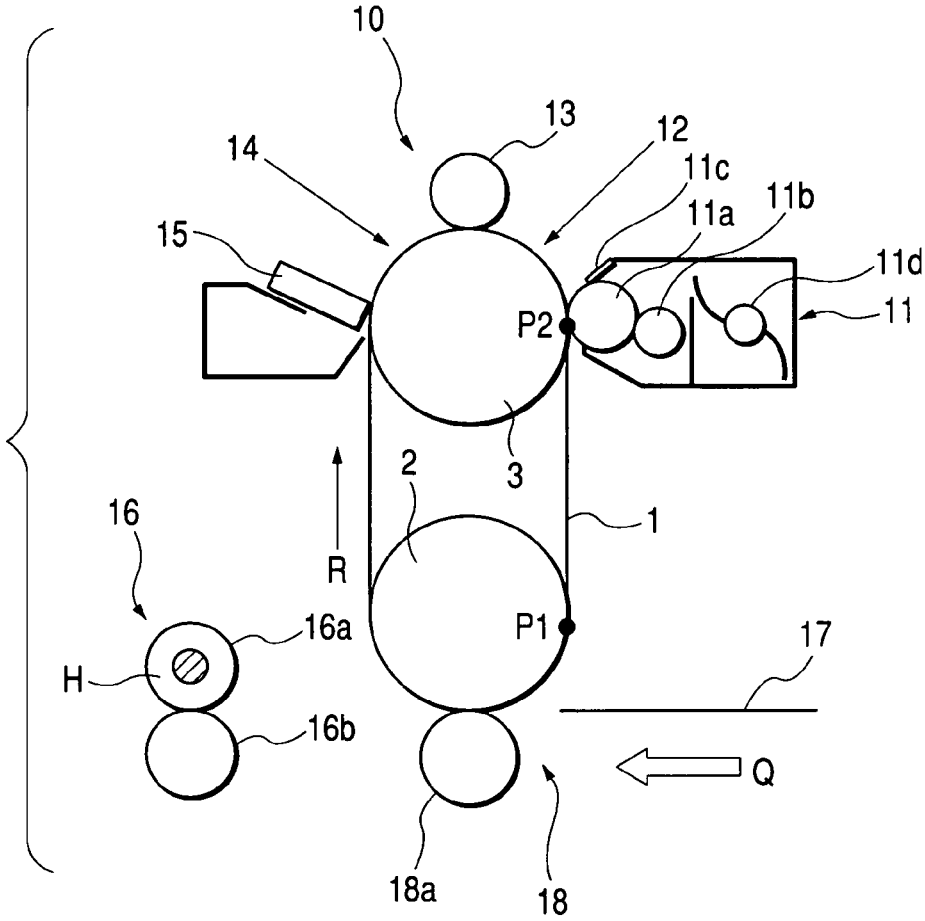
FIG. 9 is an explanatory view showing an image forming apparatus incorporating an endless belt according to a first embodiment of the invention.

Next, an explanation will be given of an example of incorporating a seamed endless belt comprising a photosensitive film in an image forming apparatus. In FIG. 9, the drive stretching member 2 and the stretching member 3 are respectively constituted by pipes and the photosensitive film 1 (hereinafter, referred to as a photosensitive belt member) is stretched between the drive stretching member 2 and the driving member 3. The tension force between the drive stretching member 2 and the stretching member 3 in this case is 26 N.

Further, as a constitution of the pipe used for the drive stretching member 2 and the stretching member 3, the pipe is made of aluminum having an outer diameter of ϕ25 mm and a wall thickness of 1.6 mm and a length of 372 mm and coated with urethane having a thickness of 50 μm at a surface thereof. A distance between centers of the pipes is 55 mm. A photosensitive member unit having such a constitution is incorporated in an image forming apparatus 10.

In FIG. 9, numeral 11 designates a developing unit which is provided with a developing roller 11*a*, a toner supply roller 11*b*, a toner control blade 11*c*, and a toner agitator 11*d*. Numeral 12 designates light ray irradiated from an exposure unit, numeral 13 designates a charging unit, numeral 14 designates light ray irradiated from a discharging unit, numeral 15 designates a cleaner unit, and numeral 16 designates a fixing unit. The fixing unit 16 is provided with a heating roller 16*a* having a heater H at inside thereof and a pressing roller 16*b*. Numeral 18 designates a transferring unit which is constituted by the drive stretching member 2 and a transferring roller 18*a*. Numeral 17 designates recording paper which is carried in a direction of an arrow Q.

Next, an explanation will be given of a procedure of forming an image by the image forming apparatus 10.

(1) The drive stretching member 2 starts driving the photosensitive belt member 1 to circulate in a direction of an arrow R.

(2) The photosensitive belt member 1 is charged to −600V by the charging unit 13.

(3) An electrostatic latent image is formed on the photosensitive belt member 1 by the light ray 12 from the exposure unit. Further, in the processing, charge at an exposed portion is nullified and charge at an unexposed portion remains.

(4) The toner is charged negatively by friction by the developing unit 11 to develop the electrostatic latent image formed on the photosensitive belt member 1. In the processing, the charge nullified portion of the exposed portion is filled by the charged toner to develop.

(5) The recording paper 17 is carried in the arrow Q direction and advances between the transferring roller 18*a* of the transferring unit 18 and the photosensitive belt member 1.

(6) The transferring unit 18 is applied with transferring bias voltage making current of +20 μA flow and a toner developed image is transferred from above the photosensitive member 1 to the recording paper 17 (recording medium).

(7) The recording paper 17 transferred with the toner image is carried to the fixing unit 16. At the fixing unit 16, the toner image on the recording paper 17 is melted to fix by operation of heat and pressure.

(8) The toner, paper powder or the like remaining on the photosensitive member 1 which has passed through the transferring unit 18 is scraped off by the cleaner unit 15.

(9) Further, the light ray 14 is irradiated from the discharging unit and the remaining electrostatic latent image on the photosensitive belt member 1 is nullified.

(10) The operation returns to the processing of (2) in the case of continuous printing.

An example of a condition of forming the image is as follows. Drive torque of the drive stretching member 2 is 0.076 (N·m). Therefore, the stretching force F1 of FIG. 1 becomes (0.076/0.0125)+26=32 N. The distance between the point P1 and the point P2 is 55 mm. The conductive layer of the photosensitive belt member 1 is connected to the ground. As a method therefor, the conducive layer is exposed at an end portion of the belt and is brought into contact with a conductive blush terminal connected to the ground. With regard to rotational speed of the photosensitive belt member, surface speed is 215 mm/sec and paper passing speed is 40 ppm in passing paper of A4 in the transverse direction.

Next, an explanation will be given of a relationship between a length and a durability of the seam portion. Durability is evaluated by changing the length of the seam portion 5 and carrying out continuous printing by the image forming apparatus shown in FIG. 9. A print image at this occasion is a character image of A4 size. In evaluating the durability, the image forming apparatus is stopped at each continuous printing of 500 sheets, a lid of the apparatus is opened and it is observed with eyes whether there is a damage of exfoliation, float-up, crack, break or the like at the seam portion 5 of the photosensitive belt member 1. Further, a total number of sheets of passing paper at a time point of bringing about the damage is defined as a life printing sheet number.

Table 1 shows the length of the seam portion and a result of evaluating the life printing sheet number.

As shown in Table 1, although there are more or less measurement dispersion, by making the seam length longer than the distance 55 mm between the point P1 and the point P2 of FIG. 9, the shear force applied on the seam portion can be reduced. Further, the life printing sheet number can be increased.

TABLE 1

| length of seam portion (mm) | life printing sheet number |
|---|---|
| 75 | 79500 |
| 65 | 80500 |
| 55 | 81000 |
| 45 | 40500 |
| 35 | 31000 |
| 25 | 22500 |
| 15 | 12500 |
| 10 | belt is cut immediately |
| 5 | belt is cut immediately |

In a case where at least one of the charging unit 13, the developing unit 11, the transferring unit 18, and the cleaner unit 15 in the image forming apparatus of FIG. 9 is a contact-type device, the force of driving to circulate the photosensitive belt member 1 needs to be higher than that in a non-contact type device. Therefore, the shear force applied to the seam portion is also increased and a degree of breaking the photosensitive belt member 1 is also increased.

However, since the shear force can be reduced by the constitution of the invention, the effect of preventing the photosensitive belt member 1 from being broken is further enhanced.

Here, the stretching member 3 may be arranged to be opposed to the transferring member 18*a* in FIG. 9.

As a second embodiment, an explanation will be given of an example of applying a seamed endless belt according to the invention as an intermediate transferring member in an image forming apparatus.

i) As a substrate, a conducive resin film having a thickness of 300 μm, a width of 340 mm and a length of 975 mm is used. The film is dispersed with 20 wt % of carbon black powder as a conductive agent in polyurethane resin.

ii) Otherwise, as a resin used for the substrate, polyethylene, polypropylene, polymethylpentene-1, polystyrene, polyamide, polycarbonate, polysulfone, polyarylate, PET, PBT, polyphenylene sulfide, polyethersulfone, plyethernitril, polyimide, polyetheretherketone, liquid crystal polymer, polyamide acid or the like can be used.

iii) Otherwise, as a conductive agent, perchlorates, or zinc oxide, tin oxide, antimony oxide, titanium oxide, respectively made conductive by doping antimony, indium or the like or metal particles or metal fibers of Cu, Al, Ni, stainless steel, or iron or carbon fiber can be used.

iv) The overlapped portion is formed by overlapping both longitudinal ends of the film (see FIG. 2) and the overlapped portion is adhered by an adhering agent (1521; Three Bond Co., Ltd.). Otherwise, the overlapped portion may be melted to adhere by heat and pressure.

v) A length of a seam portion is 347 mm and a diameter of a seamed endless intermediate transferring belt is ϕ200 mm.

Figure 10:
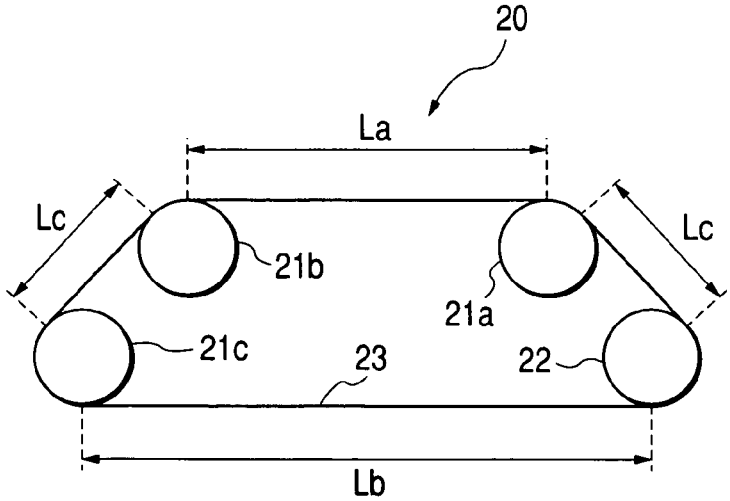
FIG. 10 is an explanatory view showing an intermediate transfer unit incorporating an endless belt according to a second embodiment of the invention.

The intermediate transferring member according to this embodiment is stretched by 4 pieces of pipes to constitute an intermediate transferring unit as shown in FIG. 10. As a constitution of the pipe, the pipe is made of aluminum having an outer diameter of ϕ30 mm, a wall thickness of 1.6 mm and a length of 372 mm and surface thereof is coated with urethane having a thickness of 50 μm.

In FIG. 10, notations 21*a* through 21*c* are first through third stretching members and numeral 22 designates a drive stretching member. Since a transporting path is formed in a trapezoidal shape by 3 pieces of the stretching members and the drive stretching member in this way, the endless belt can stably be run. The intermediate transferring belt 23 is stretched among the first through the third stretching members 21*a* through 21*c* and the drive stretching member 22. A length of the intermediate transferring belt 23 is selected such that La is 180 mm, Lb is 224 mm and Lc is 65 mm.

Figure 11:
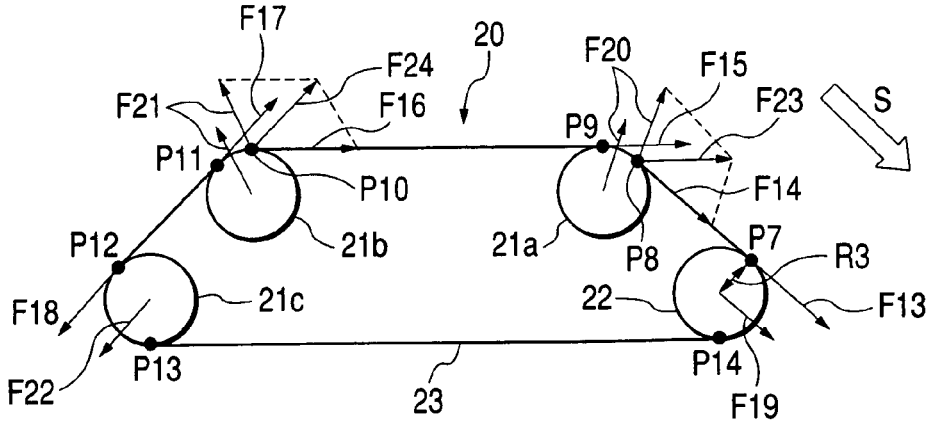
FIG. 11 is a diagram for explaining forces exerting to the intermediate transfer unit shown in FIG. 10.

FIG. 11 is an explanatory view showing equilibrium of forces exerting to the transferring unit shown in FIG. 10. When the drive stretching member 22 is driven to rotate, the intermediate transferring belt 23 is circulated in an arrow S direction. At this occasion, a stretching force F13 is exerted to a point P7 of starting to contact with the drive stretching member 22. When a rotational driving torque at this occasion is designated by notation T2(N·m), a diameter of moving the drive stretching member is designated by notation R3(m), and a tension force exerted to the drive stretching member 22 is designated by notation F19(N), F13=(T2/R3)+F19(N). Further, according to the embodiment, the tension force F13 is selected to 53 N.

Next, a stretching force F14 is exerted to a point P8 at which the intermediate transferring belt 23 starts separating from the stretching member 21*a*. Meanwhile, a stretching force F15 is exerted to a point P9 at which the intermediate transferring belt 23 starts contacting with the stretching member 21*a*. Here, a stretching force F14 is equal to the stretching force F13. The stretching force F15 is equal to F23(N) which is a synthesized force of the stretching force F14 and a tension force F20 of the stretching member 21*a*. Therefore, as magnitude of force, F15=F14=F13.

Also with regard to the stretching member 21*b*, similarly, stretching forces are F17=F16=F15. As in the case of the stretching force F15 discussed above, the stretching force F17 is equal to F24(N) which is a synthesized force of the stretching force F16 and a tension force F21 of the stretching member 21*b*. Further, a reaction force F18(N) is exerted to point P12 at which the intermediate transferring belt 23 starts separating from the stretching member 21*c*, and a tension force exerted to the stretching member 21*c* is designated by notation F22(N). As magnitude of force, reaction force F18=stretching force F17. Further, between the point P12 and a point P13, similar to the case at the point P3 and the point P5 of FIG. 1, the stretching force and the friction force received by the intermediate transferring belt 23 from the stretching member 21*c* are canceled by each other and a force of stretching the intermediate transferring belt 23 is further reduced. The same goes with an interval between a point P14 and a point P7. Therefore, also the force of stretching the intermediate transferring belt 23 is further reduced also between the point P13 and the point P14.

Summarizing the above-described, at intervals among the points P7, P8, P9, P10, P11 and point P12 of FIG. 11, is F13=(T2/R3)+F19(N). Meanwhile, at intervals among the points P12, P13, P14, and point P7, the force of pulling the intermediate transferring belt 23 is smaller than the stretching force F13. The stretching force is further reduced on the downstream side of the drive stretching member 22 in the belt rotating direction at an interval to a contiguous one of the stretching members.

Figure 12:
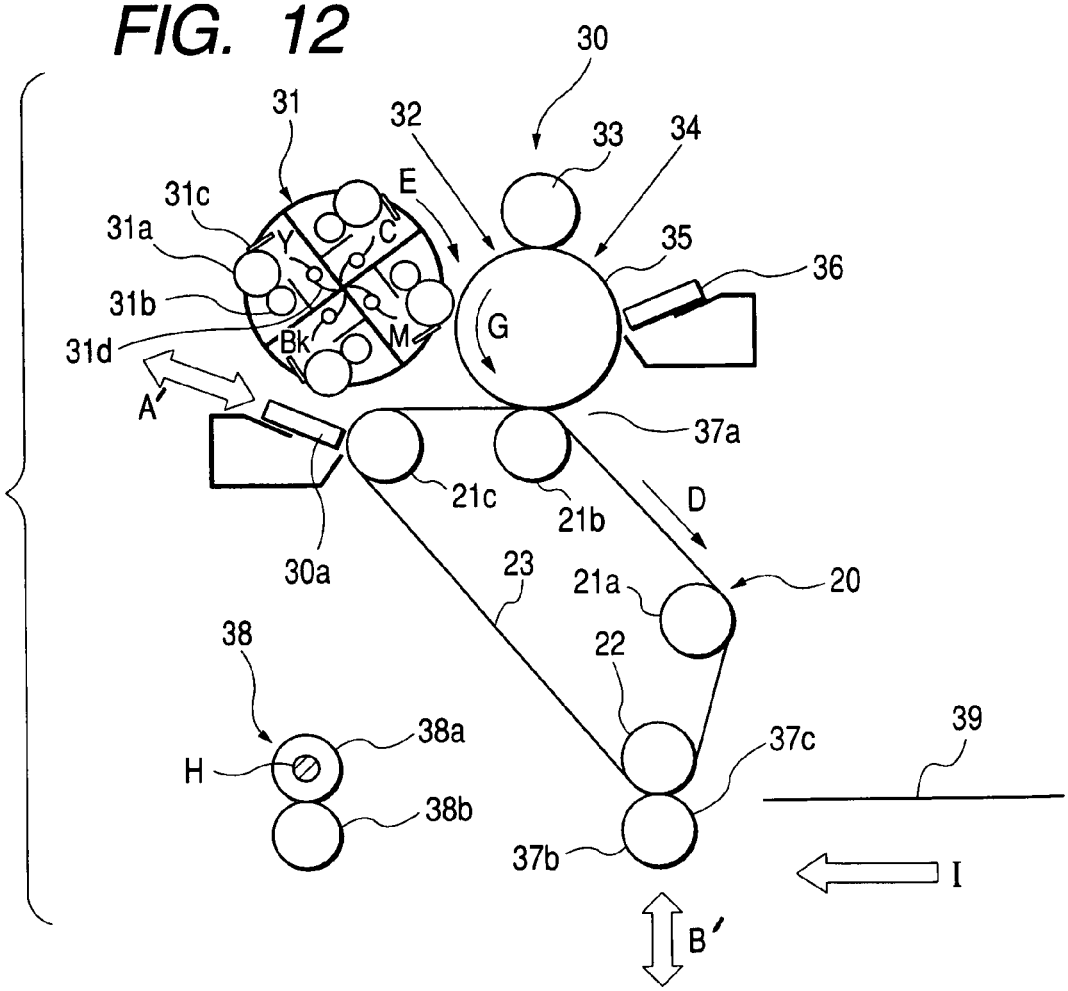
FIG. 12 is an explanatory view showing an image forming apparatus incorporating the intermediate transfer unit shown in FIG. 10.

An explanation will be given of an example of incorporating the above-described intermediate transferring unit 20 to an image forming apparatus 30. In FIG. 12, numeral 31 designates a developing unit which is provided with a developing rotary. The developing rotary is rotated in an arrow E direction. Inside of the developing rotary is divided in four and respective divisions are provided with image forming units of 4 colors of yellow (Y), cyan (C), magenta (M) and black (Bk). In the example of yellow (Y), a developing roller 31*a* and a toner supply roller 31*b*, a toner control blade 31*c* and a toner agitator 31*d* are provided. A similar constitution is provided for other color.

Numeral 32 designates light ray irradiated from an exposure unit, numeral 33 designates a charging unit, numeral 34 designates light ray irradiated from a discharging unit and numeral 35 designates a photosensitive member unit. The photosensitive member unit 35 is rotated in an arrow G direction. A primary transferring unit 37*a* is formed by the photosensitive member unit 35 and the stretching member 21*b* of the intermediate transferring unit 20. Numeral 36 designates a cleaner unit and notation 37*b* designates a secondary transferring unit which is constituted by the drive stretching member 22 and a transferring roller 37*c*. A fixing unit 38 is provided with a heating roller 38*a* having a heater H at inside thereof and a pressing roller 38*b*.

Numeral 39 designates recording paper which is carried in an arrow I direction. Notation 30*a* designates an intermediate cleaner unit which is separated from and contacted to the intermediate transferring belt 23 in arrows A' directions. The intermediate transferring belt 23 is circulated in an arrow D direction. Further, the transferring roller 37*c* is separated from and contacted with the drive stretching member 22 in arrows B' directions.

Next, an explanation will be given of a procedure of forming an image by the image forming apparatus 30 shown in FIG. 12.

(1) Assum that the intermediate cleaner unit 30*a* is separated and the second transfer unit 37*b* is brought into a separated state.

(2) A portion (M) for magenta color of the rotary developing unit 31 is opposed to the photosensitive member unit 35.

(3) The photosensitive member unit 35, the intermediate transferring belt 23 and the like start driving to rotate.

(4) The photosensitive member unit 35 is charged to −600V by the charging unit 33.

(5) An electrostatic latent image is formed on the photosensitive member unit 35 by the light ray 32 from the exposure unit (6) The electrostatic latent image is developed by the portion for magenta color of the rotary developing unit 31.

(7) The primary transferring unit 37*a* is applied with +700V to transfer a magenta developed image on the photosensitive member unit 35 onto the intermediate transferring belt 23.

(8) The transfer remaining toner of the photosensitive member unit 35 passing the primary transferring unit 37*a* is scraped by the cleaner unit 36.

(9) Further, the light ray 34 from the discharging unit is irradiated and remaining electrostatic latent image on the synthesized unit 35 is nullified.

(10) The photosensitive member unit 35 is charged to −600V by the charging unit 33.

(11) An electrostatic latent image is formed on the photosensitive member unit 35 by the exposure unit 32.

(12) The rotary developing unit 31 is rotated and a portion (C) thereof for cyan color is opposed to the photosensitive member unit 35.

(13) The electrostatic latent image is developed at the portion of the rotary developing unit 31 for cyan color.

(14) The primary transferring unit 37*a* is applied with +700V to transfer a cyan developed image on the photosensitive member unit 35 to overlap on the intermediate transferring belt 23 formed with the magenta image.

(15) The transfer remaining toner of the photosensitive unit 35 passing the primary transferring unit 37*a* is scraped by the cleaner unit 36.

(16) Further, the light ray 34 from the discharging unit is made incident to nullify the remaining electrostatic latent image on the photosensitive member unit 35.

(17) The photosensitive member unit 35 is charged to −600V by the charging unit 33.

(18) An electrostatic latent image is formed on the photosensitive member unit 35 by the light ray 32 from the exposure unit.

(19) The rotary developing unit 31 is rotated and a portion thereof for yellow color is opposed to the photosensitive member unit 35.

(20) The electrostatic latent image is developed on the photosensitive member unit 35 at the portion for yellow color of the rotary developing unit 31.

(21) The primary transferring unit is applied with +700V to transfer a yellow developed image on the photosensitive member unit 35 to overlap on the intermediate transferring belt 23 formed with magenta and cyan images.

(22) The transfer remaining toner of the photosensitive member unit 35 passing the primary transferring unit 37*a* is scraped by the cleaner unit 36.

(23) The light ray 34 from the discharging unit is made incident and the remaining electrostatic latent image on the photosensitive member unit 35 is nullified.

(24) The photosensitive member unit 35 is charged to −600V by the charging unit 33.

(25) An electrostatic latent image is formed on the photosensitive member unit 35 by the light ray 32 from the exposure unit.

(26) The rotary developing unit 31 is rotated and a portion (Bk) thereof for black color is opposed to the photosensitive member.

(27) The electrostatic latent image on the photosensitive member unit 35 is developed by the portion for black color of the rotary developing unit 31.

(28) The primary transferring unit is applied with +700V to transfer a black color developed image on the photosensitive member to overlap the intermediate transferring belt 23 formed with magenta, cyan and yellow images and a full color image is formed on the intermediate transferring belt 23.

(29) The transfer remaining toner of the photosensitive member unit 35 passing the primary transferring unit 37*a* is scraped by the cleaner unit 36.

(30) The light ray 34 from the discharging unit is made incident and the remaining electrostatic latent image is nullified.

(31) The recording paper 39 is carried in the arrow I direction of FIG. 12 and advances between the intermediate transferring belt 23 and the transferring roller 37*c* of the secondary transferring unit 37*b*.

(32) The transferring roller 37*c* of the secondary transferring unit 37*b* is brought into contact with the intermediate transferring belt 23.

(33) The secondary transferring unit 37*b* is applied with voltage for making current of +20 $\mu$A flow to transfer the full color image on the intermediate transferring belt 23 onto the recording paper 39.

(34) The recording paper 39 transferred with the full color toner image is carried to the fixing unit 38. At the fixing unit 38, the toner image on the recording paper 39 is melted to fix by heat and pressure.

(35) The intermediate transferring cleaner unit 30*a* is brought into contact with the intermediate transferring belt 23.

(36) Thereby, the transfer remaining toner or paper powder on the intermediate transferring belt 23 passing the secondary transferring unit 37*b* is scraped.

(37) The operation returns to (1) again in the case of continuous printing.

Other conditions are as follows. Drive torque of the drive stretching member is set to 0.25 (N·m). Therefore, the stretching force F13 of FIG. 11 becomes (0.25/0.015) +53=70 N. Further, a distance of points P7, P8, P9, P10, P11, P12 of FIG. 11 is 347 mm. Rotational speed of the intermediate transferring belt 23 is 215 mm/sec in surface speed and paper passing speed is 10 ppm of A4 paper passing transversely.

Next, an explanation will be given of a relationship between a length and durability of the seam portion. The durability is evaluated by changing the length of the seam portion and carrying out continuous printing by the image forming apparatus shown in FIG. 12. A printed image is a full color character image of A4 size. In evaluating the durability, the image forming apparatus is stopped at each continuous printing of 500 sheets and a lid of the apparatus is opened to observe with eyes whether the damage of exfoliation, float-up, crack, break or the like is present at the seam portion of the intermediate transferring belt. Further, a total number of sheets of passing paper at a time point of bringing about the damage is defined as a life printing sheet number.

Table 2 shows a result of evaluating the length of the seam portion and the life printing sheet number.

TABLE 2

| length of seam portion (mm) | life printing sheet number |
|---|---|
| 367 | 50500 |
| 357 | 49500 |
| 347 | 50000 |
| 337 | 29500 |
| 327 | 29000 |
| 317 | 27500 |
| 50 | belt is cut immediately |
| 30 | belt is cut immediately |

As shown in Table 2, although there is more or less measurement dispersion, by making the seam length longer than he distance 347 mm of points P7, P8, P9, P10, P11, P12 of FIG. 11, shear force exerted to the seam portion can be reduced. Further, the life printing sheet number can be increased.

When at least one of the primary transferring unit, the secondary transferring unit and the intermediate cleaning unit in the image forming apparatus of FIG. 12 is a contact-type device (including a device which is brought into contact therewith when the transfer or the cleaning is performed and separated therefrom in other case), a force of driving to circulate the intermediate transferring belt needs to be higher than that in the non-contact type. Therefore, also the shear force applied to the seam portion is increased and a degree of breaking the intermediate transferring 23 is also increased. However, since the shear force can be reduced by the constitution of the invention, the effect of preventing the intermediate transferring belt 23 from breaking can further be enhanced.

In this embodiment, the image forming apparatus shown in FIG. 12 is constructed by a constitution in which the intermediate transferring belt 23 as explained in reference to FIG. 10 runs on a transporting path in the trapezoidal shape. However, the intermediate transferring belt can also be configured by a constitution of being stretched between the drive stretching member and the stretching member as shown in FIG. 1. In this case, for example, the drive stretching member is arranged to be opposed to the photosensitive member unit 34.

As a third embodiment, an explanation will be given of an example of applying a seamed endless belt according to the invention as a fixing belt in an image forming apparatus.

i) As a substrate, a polyimide film having a thickness of 200 $\mu$m, a width of 340 mm and a length of 122 mm is used.

ii) Otherwise, as a resin for the substrate, polyethylene, polypropylene, polypropylene, polymehylpentene-1, polystyrene, polyamide, polycarbonate, polysulfone, polyarylate, PET, PBT, polyphenylene sulfide, polyethersulfone, polyethernitril, plyimide, polyetheretherketone, fluororesin, liquid crystal polymer, polyamide acid or the like can be used.

iii) The fixing belt may be made conductive to escape static electricity with an object of preventing the toner from being scattered by electrostatic repulsion in fixing. In this case, as a conductive additive agent, perchlorates, or a compound made conductive by doping antimony, indium or the like to each of zinc oxide, tin oxide, antimony oxide, titanium oxide, or metal particles or metal fibers of Cu, Al, Ni, stainless steel, iron or carbon fiber or the like can be used.

iv) An overlapped portion for partially overlapping both longitudinal ends of the film is formed (see FIG. 2) and the overlapped portion is adhered by an adhering agent (KS9100; Hitachi Chemical Co., Ltd.). Otherwise, the film may be welded to adhere by heat and pressure.

v) A length of the seam portion is 22 mm and a diameter of the formed fixing belt is $\phi$32 mm.

Figure 13:
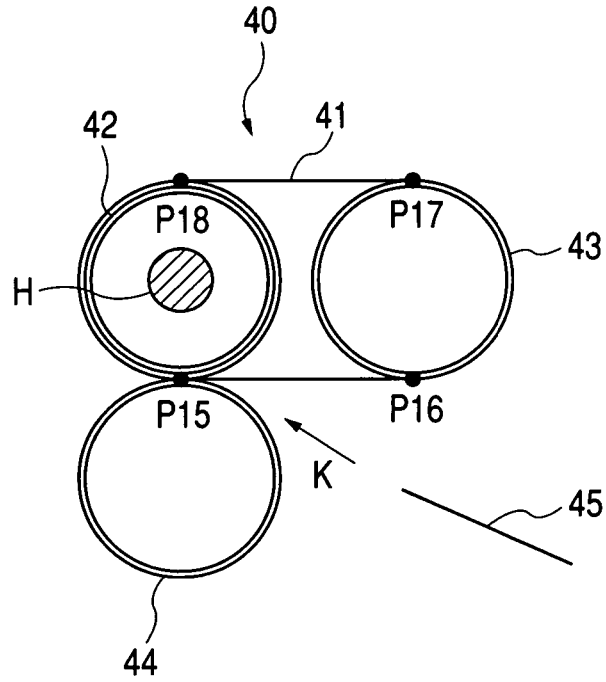
FIG. 13 is an explanatory view showing a fixing unit incorporating an endless belt according to a third embodiment of the invention.

FIG. 13 shows an example of constituting a fixing unit 40 by using the seamed endless belt according to this embodiment. In this figure, numeral 41 designates a fixing belt and numeral 42 designates a heating member provided with a heat generator H and serving as a drive stretching member. Numeral 44 designates a pressing member and numeral 43 designates a stretching member. Also, a recording medium 45 is supplied in a direction K to a position between the belt 41 and the pressing member 44.

As the drive stretching member 42, a surface of a pipe made of aluminum having an outer diameter of $\phi$18 mm, a wall thickness of 1 mm and a length of 372 mm is coated with silicone rubber having a thickness of 300 $\mu$m. Further, a halogen lamp of 1050 W is arranged as the heat generator at inside thereof. The stretching member 43 is a pipe made of aluminum having an outer diameter of $\phi$18 mm, a wall thickness of 1 mm and a length of 372 mm. As the pressing member 44, a surface of a pipe made of aluminum having an outer diameter $\phi$18 mm, a wall thickness of 1 mm and a length of 372 mm is coated with a PFA tube having a thickness of 30 $\mu$m. A distance between a center of the drive stretching member 42 and a center of the stretching member 43 is set to 22 mm. Further, the drive stretching member 42 and the pressing member 44 are pressed by a total load of 3 kg.

As has been explained of operation of force in reference to FIG. 1, the fixing belt 41 is exerted with a stretching force and a reaction force thereof between points P15 and P16. Meanwhile, among points of P16, P17, P18, P15, a force of stretching the fixing belt is further reduced. Further, a tension force between the drive stretching member 42 and the stretching member 43 is 15 N and drive torque of the drive stretching member 42 is 0.1 N·m. Therefore, the stretching force of the fixing belt exerted between the points P15 and P16 becomes (0.1/0.009)+15=26 N.

Next, an explanation will be given of an example of incorporating the above fixing unit explained in place of the constitution of the fixing unit 38 of the image forming apparatus 30 shown in FIG. 12. Here, a distance between the points P15 and P16 is 22 mm. Further, the circulation speed of the fixing belt 41 is set to 215 mm/sec as surface speed and paper passing speed is set to 10 ppm of A4 paper passing transversely and fixing temperature is set to 190° C.

An explanation will be given of a relationship between a length and durability of a seam portion according to the embodiment. The durability is evaluated by changing the length of the seam portion. A printed image is a full color character image of A4 size. In evaluating the durability, the image forming apparatus is stopped at each continuous printing of 500 sheets and a lid of the apparatus is opened to observe with eyes whether there is damage of exfoliation, float-up, crack, break or the like at the seam portion of the intermediate transferring belt. Further, a total seat number of passing paper at a time point of bringing about such a damage is defined as a life printing sheet number.

Table 3 shows a result of evaluating the length of the seam portion and the life printing sheet number.

TABLE 3

| length of seam portion (mm) | life printing sheet number |
|---|---|
| 42 | 30000 |
| 32 | 30000 |
| 22 | 31000 |
| 12 | belt is cut immediately |
| 2 | belt is cut immediately |

As shown in Table 3, although there is more or less measurement dispersion, by making the seam length longer than the distance 22 mm between the points P15 and P16 of FIG. 13, shear force exerted to the seam portion can be reduced. Further, the life printing sheet number can be increased.

The following advantages are obtained according to the embodiment.

i) The higher the temperature of a portion of the seam portion for melting to adhere resin or adhering agent or the like, the lower the adhering strength. Therefore, in the case of the fixing belt used at a temperature higher than that of the photosensitive belt member or the intermediate transferring belt used at room temperature, a force of stretching the fixing belt needs to be further reduced. According to the embodiment, since the force of stretching the fixing belt can be reduced as described above, the adhering strength can be maintained.

ii) Further, by using epoxy resin, urea resin or a thermosetting compound added therewith as the adhering agent, the high adhering strength can be maintained even at high temperature. When the compound is used along with the invention, a fixing belt having longer life can be realized. The fixing unit explained in reference to FIG. 13 can be used in place of the fixing unit 16 of the image forming apparatus described in FIG. 9. The endless belt 1 of FIG. 9 in this case having the length of the seam portion of the constitution of the invention can be used. Further, a constitution of a prior art can also be constituted thereby.

As a fourth embodiment, an explanation will be given of another example of applying a seamed endless belt according to the invention as a fixing belt in an image forming apparatus.

i) As a substrate, a polyimide film having a thickness of 200 $\mu$m, a width of 340 mm and a length of 129 mm is used.

ii) Otherwise, as a resin for the substrate, polyethylene, polypropylene, polymethylpentene-1, polystyrene, polyamide, polycarbonate, polysulfone, polyarylate, PET, PBT, polyphenylene sulfide, polyethersulfone, polyethernitril, polyimide, polyetheretherketone, fluororesin, liquid crystal polymer, polyamide acid or the like can be used.

iii) Further, a fixing belt may be made conductive to escape static electricity with an object of preventing a toner from being scattered by electrostatic repulsion in fixing. In this case, as a conductive additive agent, perchlorates, or a compound made conductive by doping antimony, indium or the like to each of zinc oxide, tin oxide, antimony oxide, or titanium oxide, or metal particles or metal fibers of Cu, Al, Ni, stainless steel, iron, or carbon fiber or the like can be used.

iv) An overlapped portion is formed by partially overlapping both longitudinal ends of the film (see FIG. 2) and the overlapped portion is adhered by an adhering agent (KS9100; Hitachi Chemical Co., Ltd.). Otherwise, the film may be welded to adhere by heat and pressure.

v) A width of a seam portion is 10 mm and a diameter of the formed fixing belt is $\phi$37.8 mm.

Figure 14:
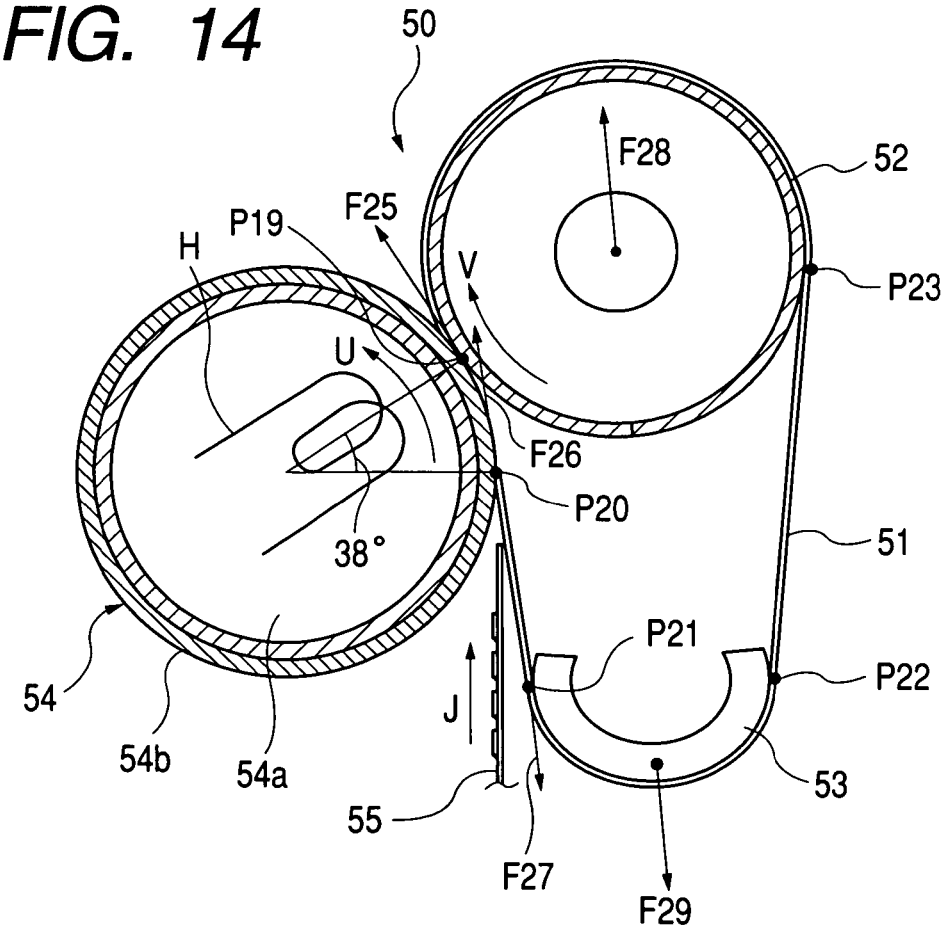
FIG. 14 is an explanatory view showing a fixing unit incorporating an endless belt according to a fourth embodiment of the invention.

A fixing unit (fixing device) 50 is constituted by using the seamed endless belt according to this embodiment as shown in FIG. 14. In this figure, numeral 51 designates a fixing belt, numeral 52 designates a drive stretching member, numeral 53 designates a stretching member in a semiannular shape, and numeral 54 designates a heating member having a heat generator H.

As the drive stretching member 52, a pipe made of stainless steel having an outer diameter of $\phi$25 mm, a wall thickness of 0.4 mm and a length of 372 mm is used. A surface of the pipe is coated with silicone rubber having a thickness of 300 $\mu$m.

The stretching member 53 in the semiannular shape made of PTFE resin having an outer radius of curvature of 8 mm, a wall thickness of 4 mm and a length of 372 mm is used. Otherwise, fluororesin of PFA, FEP, PCTFE or the like, polyacetal, polybenzimidazole, ABS, ACS, AES, alkyd resin, uria resin, melamin resin, phenolic resin, bismaleimide triazine resin, ASA, chlorinated polyether, diallylphthalate resin, furan resin, polyamideimide, polyallylate, polyallylsulfone, polybutylene, epoxy resin, aromatic polyester, liquid crystal polymer, polyamide, PET, PBT, polycarbonate, polyetheretherketone, polyetherimide, polyetherketone, polyethernitril, polyethersulfone, polythioethersulfone, polyimide, polyaminobismaleide, polyketone, polymethylpentene, norbornene resin, polyphenylene sulfide, polysulfone, unsaturated polyester resin, SAN, polyurethane or the like can be used.

In this way, since a material of the stretching member 53 uses not a metal but a resin having excellent insulating performance, the heat of the fixing belt 51 can be prevented from being deprived by the stretching member 53. Therefore, a time period of heating the fixing belt 51 from a state of room temperature to desired temperature (warm up) can be shortened.

Further, since the stretching member is constituted by the semiannular shape, material cost can be reduced in comparison with that of the case of using the stretching member in a cylindrical shape as shown by FIG. 11.

In a case where the printing operations are performed with intervals, warm up of the fixing unit is repeated. At this occasion, since a time period of exposing the fixing belt 51 to high temperature by warm up can be shortened, thermal fatigue or thermal deterioration of the seam portion is reduced. As a result, a fixing belt having longer life can be realized.

As the heating member 54, a pipe 54*a* made of stainless steel having an outer diameter of $\phi$25 mm, a wall thickness of 0.4 mm and a length of 372 mm is used. A surface of the pipe is coated with silicone rubber having a wall thickness of 400 $\mu$m and a PFA tube 54*b* having a thickness of 30 $\mu$m is coated thereon. Further, as the heat generator at inside of the heating member, a halogen lamp of 1050 W is arranged.

A portion of the fixing belt 51 is made to wrap between a point P19 and a point P20 of the heating member 54. An angle of a circular arc between P19 and P20 is 38°. A distance between the point P20 and a point P21 is 10 mm, a tension force F28 (F29) between the drive stretching member 52 and the stretching member 53 is 13N and drive torque of the drive stretching member 52 is 0.13 (N·m). Further, the drive stretching member 52 and the pressing member 54 are pressed by a total load of 10 kg.

Next, an explanation will be given of equilibrium of force of the fixing unit shown in FIG. 14. A force F25 for driving to rotate the drive stretching member 52 is transmitted to the heating member 54 via the fixing belt 51.

Further, at the point P20 at which the fixing belt 51 starts separating from the heating member 54, a stretching force F26 is exerted to the fixing belt 51. Further, a reaction force F27 is exerted to the point P21 at which the fixing belt 51 starts contacting the stretching member 53.

In this case, since the heating member 54 also serves as the drive stretching member, between the point P19 and the point P20, the stretching force and the friction force are canceled by each other, so that a force of stretching the fixing belt 51 is further reduced. Therefore, the driving force is F25=(0.13/0.0125)+13=23.4 N>stretching force F26 =reaction force F27. Further, the force of stretching the fixing belt 51 is further reduced also between points P21 and P22 and between points P23 and P19 at which the stretching force and the friction force are cancelled by each other.

In the example of FIG. 14, there is a constructed a constitution in which: i) the heating member 54 is arranged at a position opposed to the drive stretching member 52 via the fixing belt 51; ii) a portion of the fixing belt 51 is made to wrap the heating member 54; and iii) the drive force is transmitted to the heating member 54 by driving the drive stretching member 52.

Therefore, at a portion of the heating member 54 at which the fixing belt 51 is made to wrap, when the friction force received by the fixing belt 51 of the heating member 54 is designated by notation Fa and a resultant force of the tension force of the drive stretching member 52 and the stretching force received by the fixing belt 51 by the torque of driving to rotate the drive stretching member 52 is designated by notation Fb, Fa and Fb are canceled by each other. Therefore, when a stretching force Fc at the point P19 at which the fixing belt 51 starts separating from the heating member 54, Fc=Fb−Fa<Fb.

Therefore, the stretching force Fb by the drive stretching member 52 can be reduced by the friction force Fa of the heating member 54 and the maximum stretching force Fc exerted to the fixing belt 51 can be reduced. Therefore, shear force exerted to an adhering layer of the seam portion can further be reduced. In this way, by using the fixing belt at the fixing unit having the constitution shown by FIG. 14, a seemed belt having longer life can be realized. According to the example of FIG. 14 in the fixing apparatus having the constitution in which the heating member is arranged by being partially brought into contact with the drive stretching member and the endless belt is run along the contact portion, damage of exfoliation or break of the seam portion of the endless belt can be prevented.

Next, an explanation will be given of an example of constituting an image forming apparatus by incorporating the fixing unit 50 shown in FIG. 14 in place of the fixing unit 38 shown in FIG. 12. Here, a distance between the points P20 and P21 of FIG. 14 is set to 10 mm. Further, circulating speed of the fixing belt 51 is set to 215 mm/sec by surface speed and paper passing speed is set to 10 ppm in A4 paper passed transversely and the fixing temperature is set to 190° C.

Further, also in the image forming apparatus shown in FIG. 9, the fixing unit of FIG. 14 can be used in place of the fixing unit 16.

In the constitution, durability is evaluated by changing the length of the seam portion of the fixing belt 51. A printed image is a full color character image of A4 size. In evaluating the durability, the image forming apparatus is stopped at each continuous printing of 500 sheets, a lid of the apparatus is opened to observe with eyes whether there is damage of exfoliation, float-up, crack, break or the like at the seem portion of the intermediate transferring belt. Further, a total seat number of passing paper at a time point of bringing about such a damage is defined as a life printing heat number.

Table 4 shows a result of evaluating the length of the seam portion and the life printing sheet number.

From Table 4, although there is more or less measurement dispersion, by making the seam length longer than the distance of 10 mm between the points P20 and P21 of FIG. 14, the shear force exerted to the seam portion can be reduced. Further, the life printing sheet number can be increased.

TABLE 4

| length of seam portion (mm) | life printing sheet number |
|---|---|
| 20 | 40500 |
| 15 | 40000 |
| 10 | 40500 |
| 8 | 15500 |
| 5 | belt is cut immediately |

As a fifth embodiment, an explanation will be given of still another example of applying a seamed endless belt according to the invention as a fixing belt in an image forming apparatus.

Figure 15:
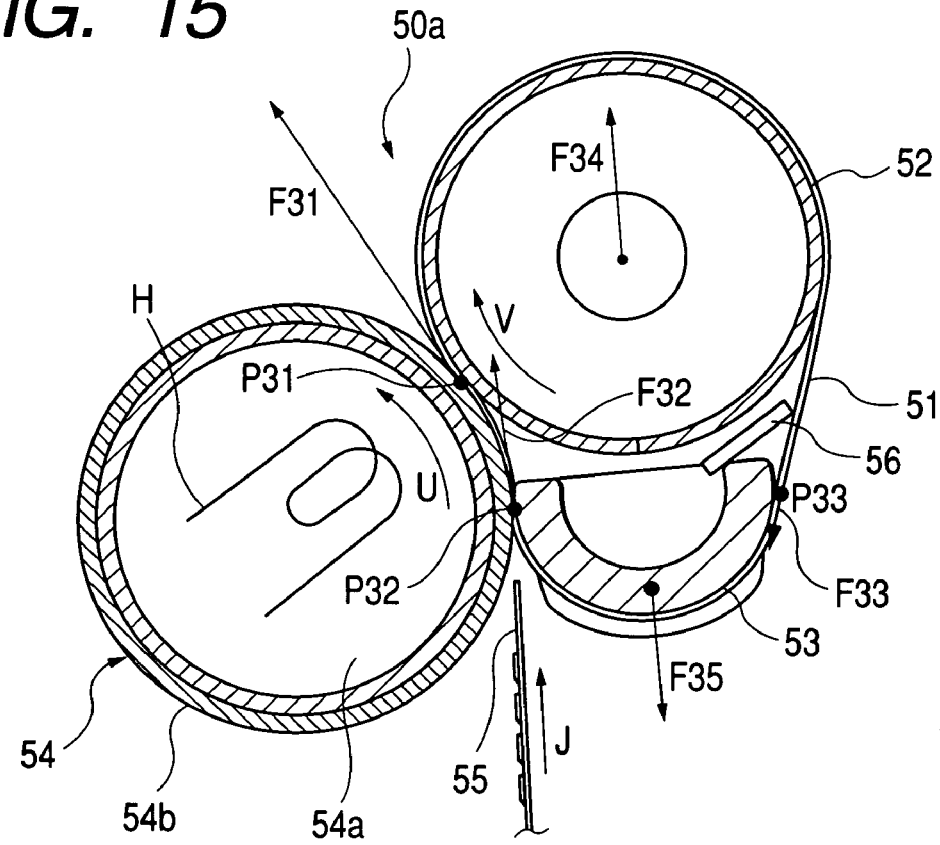
FIG. 15 is an explanatory view showing a fixing unit incorporating an endless belt according to a fifth embodiment of the invention.

In FIG. 15, numeral 50*a* designates a fixing unit, numeral 51 designates a fixing belt, numeral 52 designates a drive stretching member, numeral 53 designates a stretching member in a semiannular shape, numeral 54 designates a heating member having a heat generator H, numeral 55 designates recording paper (recording medium) and numeral 56 designates a cleaning member.

The drive stretching member 52 and the stretching member 53 are respectively brought into contact with the heating member 54. A portion of the fixing belt 51 is made to wrap between a point P31 and a point P32 of the heating member 54. The heating member 54 serves as a pressing member for pressing the fixing belt 51 to the drive stretching member 52. The drive stretching member 52 is rotated in an arrow V direction and drive force is transmitted to the heating member 54 to thereby rotate the heating member 54 in an arrow U direction.

Next, an explanation will be given of equilibrium of forces in the fixing unit shown in FIG. 15. A rotational drive force F31 of the drive stretching member 52 is transmitted to the heating member 54 at the point P31. The drive force F31 becomes a resultant force of a tension force F34 and rotational drive torque of the drive stretching member 52. Between the points P31 to P32, since the drive force F31 and a friction force (caused by a friction torque of the pressing member) are canceled by each other, a force of stretching the belt (stretching force F32) becomes smaller than the drive force F31.

Therefore, when a stretching force applied to the belt at the point P32 is designated by notation F32, F32<F31.

Figure 16:
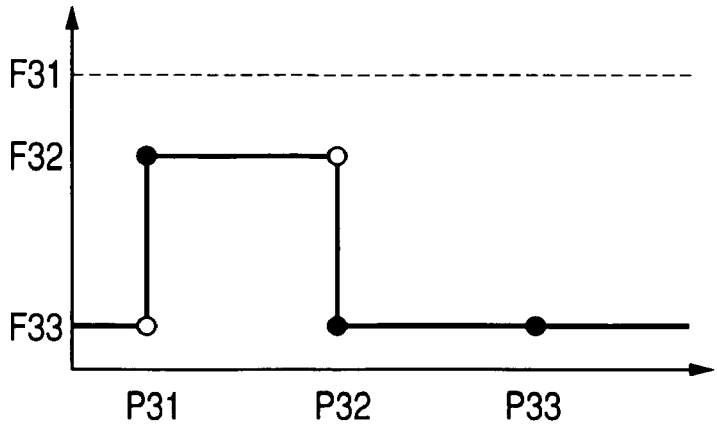
FIG. 16 is a diagram for explaining forces exerting to the endless belt shown in FIG. 15.

Further, between the points P32 and P33, the stretching force F32 is further reduced by a dynamic friction force of the belt and the belt stretching member 53. Therefore, when a stretching force exerted to the belt at the point P33 is designated by notation F33, F33<F32. FIG. 16 is a schematic view showing the stretching forces exerted to the fixing belt 51 at the respective points P31, P32 and P33. In this figure, white circles and black circles represent that the force F32 (not F33) is exerting to the point P31 in FIG. 15, for example.

In FIG. 15, numeral 50*a* designates a fixing unit, numeral 51 designates a fixing belt, numeral 52 designates a drive stretching member, numeral 53 designates a stretching member in a semiannular shape, numeral 54 designates a heating member having a heat generator H, numeral 55 designats recording paper (recording medium) and numeral 66 designates a cleaning member.

The drive stretching member 52 and the stretching member 53 are respectively brought into contact with the heating member 54. A portion of the fixing belt 51 is made to wrap between a point P31 and a point P32 of the heating member 54. The heating member 54 serves as a pressing member for pressing the fixing belt 51 to the drive stretching member 52. The drive stretching member 52 is rotated in an arrow V direction and drive force is transmitted to the heating member 54 to thereby rotate the heating member 54 in an arrow U direction.

FIG. 2 is a perspective view showing an example of an endless belt used as the fixing belt 51 shown in FIG. 15. In FIG. 2, numeral 4 designates a film, numeral 5 designates a seam portion overlapping both end portions of the film 4 and the endless belt is formed by the film 4. A film on an upper side of the seam portion 5 is designated by notation 4*a* and a film on a lower side thereof is designated by notation 4*b*.

FIG. 4 is a schematic view showing forces exerted to the seam portion 5 of the endless belt. In FIG. 3, numeral 6 designates an adhering layer of the seam portion 5. As shown by FIG. 3, the adhering layer 6 of the seam portion 5 of the endless belt is exerted with a shear force γ1 by a stretching force F1 and a shear force γ2 by a reaction force F2.

Here, when a length of the seam portion 5 is designated by notation L(m) and a width of the belt (width of the adhering layer) is designated by notation W(m), $\gamma 1=F1/(L\cdot W)=F2/(L\cdot W)=\gamma 2$ (N/m)=(Pa) is established. Therefore, it is shown that the shear force γ1 (γ2) is reduced in inverse proportion to the length L of the seam portion. Further, the stretching force F1 and the reaction force F2 are equal to the stretching force F32 shown in FIGS. 15 and 16.

Further, when a distance between the point P31 and the point P32 of FIG. 15 is designated by notation Lh(m), in the case of L=Lh, the stretching force F1 and the reaction force F2 become equal to the stretching force F33 shown in FIG. 16. In view of FIG. 16, F33<F32 is established and therefore, the shear force γ1 (γ2) is also reduced. Thereafter, in the case of L>Lh, the shear force is saturated. FIG. 4 is an explanatory view showing a relationship between the length L of the seam portion and the shear force γ1 (γ2). In view of FIG. 4, the shear force γ1 (γ2) exerted to the adhering layer 6 can be minimized by making the length L of the seam portion equal to or larger than the distance Lh between the point P31 and the point P32.

In this embodiment, the length of the seam portion is made to be equal to or larger than the distance Lh between the point P31 at which the heating member (pressing member) 54 is brought into contact with the drive stretching member 52 and the point P32 at which the heating member 54 is brought into contact with the stretching member 53.

Figure 17:
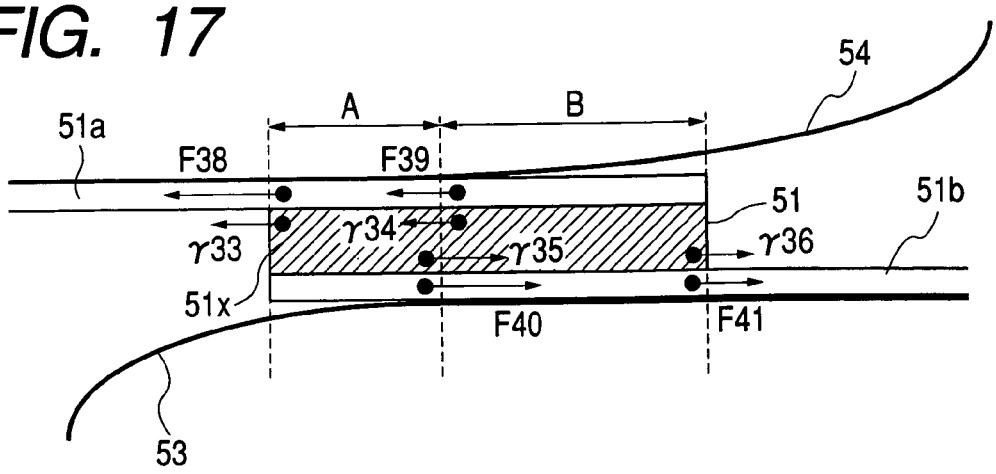
FIG. 17 is a diagram for explaining forces exerting to the endless belt which is brought into contact with a stretching member shown in FIG. 15.

FIG. 17 is a schematic view showing forces exerted to the endless belt when a portion of the seam portion of the fixing belt is brought into contact with the stretching member 53. In this figure, notation 51*x* designates the adhering layer of the fixing belt, notation 51*a* designates one surface of the fixing belt and notation 51*b* designates other surface of the fixing belt. The seam portion of the fixing belt 51 is disposed at a position between P31 and P32 of FIG. 15 and is brought into contact with the stretching member 53.

At portion A at which the seam portion is not brought into contact with the stretching member 53, a shear force γ33 by a stretching force F38 and a shear force γ35 by a reaction force F40 are exerted to the adhering layer 51*x*. Further, at portion B at which the seam portion is brought into contact with the stretching member 53, a shear force γ34 by a stretching force F39 and a shear force γ36 by a reaction force F41 are exerted to the adhering layer. Further, a relationship of F39<F38 and F41<F40 is established by a friction force received from the stretching member 53.

Therefore, relationships of the forces and forces in FIG. 3 are as follows.

$$F38+F39<F1,\ \gamma 33+\gamma 34<\gamma 1,\ F40+F41<F2,\ \gamma 35+\gamma 36<\gamma 2$$

That is, when a portion of the seam portion is brought into contact with the stretching member 53, a shear force exerted to a total of the adhering layer 51*x* becomes smaller than γ1, γ2 of FIG. 3. Even when a portion of the seam portion is brought into contact with the drive stretching member 52, a shear force exerted to the total of the adhering layer 51*x* similarly becomes smaller than γ1, γ2 of FIG. 3.

Therefore, the shear force γ1 (γ2) exerted to the adhering layer of the fixing belt can be minimized by making the length L of the seam portion equal to or larger than the distance Lh between the point P31 and the point P32. The shear force γ1 (γ2) exerted to the adhering layer of the fixing belt can be minimized whenever at least a part of the seam portion is disposed between the point P31 and the point P32. Therefore, damage of the fixing belt can be prevented and the service life can be prolonged.

In this embodiment, it is configured that: i) the heating member 54 is arranged at a position opposed to the drive stretching member 52 via the fixing belt 51; ii) a portion of the fixing belt 51 is made to wrap the heating member 54; and iii) the drive stretching member 52 is driven to transmit the drive force to the heating member 54.

Therefore, when at a portion of the heating member 54 for wrapping the fixing belt 51, a friction force Fa received by the fixing belt 51 from the heating member 54 and a resultant force Fb of the tension force of the drive stretching member 52 and a stretching force received by the fixing belt 51 by a torque of driving to rotate the drive stretching member 52 are canceled by each other. Therefore, when a stretching force at the point P31 at which the fixing belt 51 starts separating from the heating member 54 is designated by notation Fc, Fc=Fb−Fa<Fb.

Therefore, the stretching force Fb by the drive stretching member 52 can be reduced by the friction force Fa of the heating member 54 and the maximum stretching force Fc exerted to the fixing belt 51 can further be reduced. Therefore, the shear force exerted to the adhering layer can further be reduced. In this way, by using the fixing belt at the fixing unit having the constitution as shown by FIG. 15, a seamed belt having long service life can be realized. That is, in the fixing unit having the constitution in which the heating member is arranged by partially brought into contact with the drive stretching member and the endless belt is run along the contact portion, damage of exfoliation, break or the like of the seam portion of the endless belt can be prevented.

The endless belt in this embodiment is almost similar to that explained as the fourth embodiment. The detailed explanations are omitted and only the different matters will be described below.

A polyimide film having a thickness of 200 μm, a width of 340 mm and a length of 107 mm is used as a base material.

A length of a seam portion is 9 mm and a diameter of the formed fixing belt is ϕ31 mm.

The fixing unit 50*a* of this embodiment is almost similar to that examined as the fourth embodiment. The detailed explanations are omitted and only the different matters will be described below.

A portion of the fixing belt 51 is made to wrap the heating member (pressing member) 54 (between point P31 and point P32) and a length thereof is 8.6 mm. A tension force F34 (F35) of the drive stretching member 52 and the stretching member 53 is 13 N, drive torque of the drive stretching member 52 is 0.13 N·m. Further, the drive stretching member 52 and the heating member 54 are pressed by a total load of 10 kg and the stretching member 53 and the heating member 54 are pressed by a total load of 3 kg.

Figure 18:
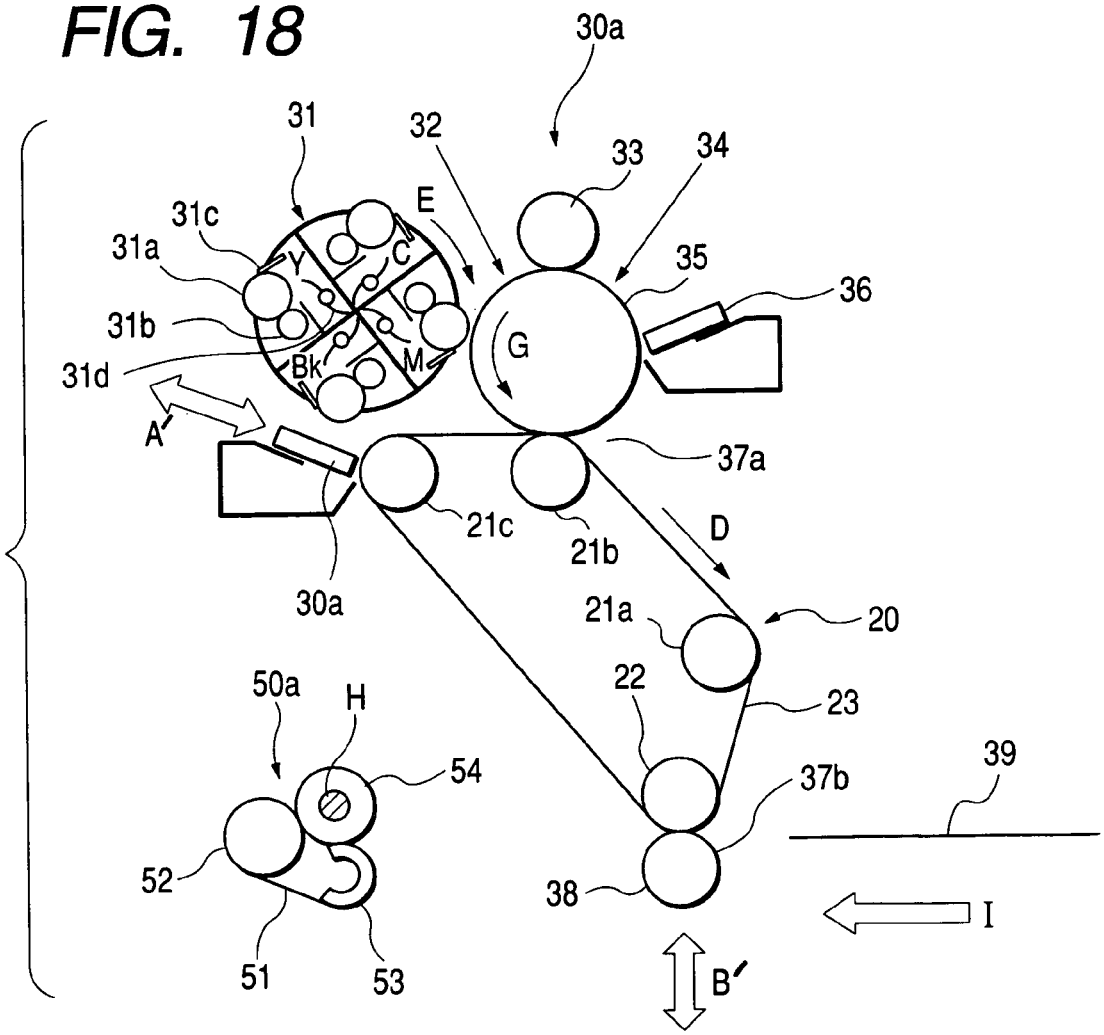
FIG. 18 is an explanatory view showing an image forming apparatus incorporating the fixing unit shown in FIG. 15.

FIG. 18 shows an example of an image forming apparatus 30*a* incorporating the fixing unit 50*a* of this embodiment. Since the elements other than the fixing unit 50*a* are identical with those in FIG. 12, the detailed explanations are omitted.

The drive torque of the drive stretching member 52 is set to 0.13 (N·m). Therefore, the drive force F31 of FIG. 15 becomes as follows.

$$(0.13/0.0125)+13=23.4\ \text{N}$$

Next, an explanation will be given of a relationship between a length and durability of the seam portion of the fixing belt. The durability is evaluated by changing the length of the seam portion and carrying out continuous printing by the image forming apparatus shown in FIG. 18. A printed image is a full color character image of A4 size. In evaluating the durability, the image forming apparatus is stopped at each continuous printing of 500 sheets and a lid of the apparatus is opened to observe with eyes whether the damage of exfoliation, float-up, crack, break or the like is present at the seam portion of the intermediate transfer belt. Further, a total number of sheets of passing paper at a time point of bringing about the damage is defined as a life printing sheet number. Table 5 shows the length of the seam portion and a result of evaluating the life printing sheet number.

TABLE 5

| length of seam portion (mm) | life printing sheet number |
|---|---|
| 12 | 59500 |
| 10 | 60000 |
| 9 | 59500 |
| 8 | 30500 |
| 6 | 22500 |
| 4 | belt is cut immediately |

As shown in Table 5, although there is more or less measurement dispersion, by making the seam width longer than the length 8.6 mm between the points P31 and P32 of FIG. 15, the shear force exerted to the seam portion can be reduced. Further, a life printing sheet number can be increased.

The higher the temperature of the adhering portion of the seam portion of the fixing belt for melting resin or the adhering agent or the like, the lower the adhering strength. Therefore, the fixing belt used at high temperature needs to make the force of stretching the fixing belt lower than that of the photosensitive belt member or the intermediate transfer belt used at room temperature. According to the invention, since the force of stretching the fixing belt can be reduced as described above, when the fixing device of the invention is used, the effect of preventing damage of the fixing belt can further be enhanced.

Further, by using epoxy resin, urea resin or a thermosetting compound added therewith as the adhering agent, the high adhering strength can be maintained even at high temperature. By using such an adhering agent in the fixing device of the constitution of the invention, a fixing belt having longer service life can be realized.

Figure 19:
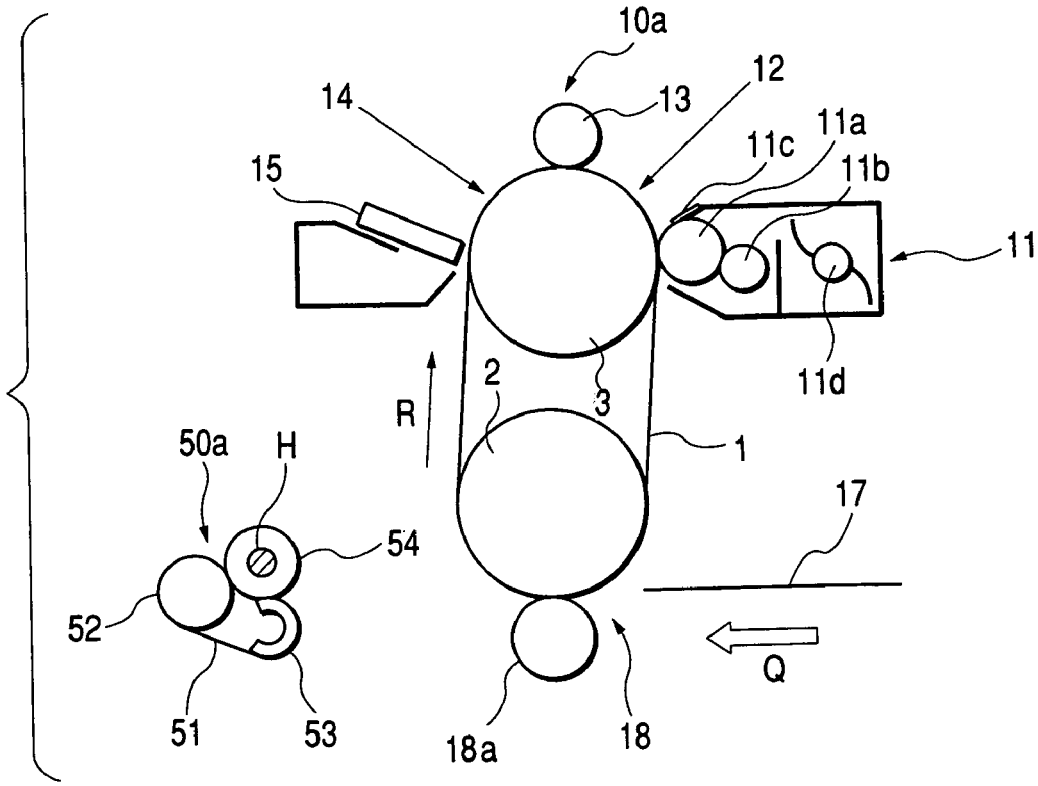
FIG. 19 is an explanatory view showing another image forming apparatus incorporating the fixing unit shown in FIG. 15.

FIG. 19 shows another example of an image forming apparatus 10*a* incorporating the fixing unit 50*a* of the fifth embodiment. Since the elements other than the fixing unit 50*a* are identical with those in FIG. 9, the detailed explanations are omitted.

Next, a sixth embodiment of the invention will be described with reference to FIG. 20. In this figure, an endless belt 1 is formed by winding a substrate 4. A seam portion 5 indicated by a hatched portion is formed by adhering a portion of the wound substrate 4 overlapping an inner side layer 4*a* and an outer side layer 4*c* thereof. A length of the seam portion is made to be equal to or larger than a length Lx of a circumference of a wound portion 4*b* of the substrate 4, that is, equal to or larger than an amount of the circumference.

In this way, according to the belt for an image forming apparatus of the invention, the seam portion is formed not only at both longitudinal end portions of the substrate as in the above embodiments but the seam portion is formed by the length equal to or larger than the amount of the circumference of the wound substrate 4. Therefore, even when the endless belt is stretched between stretching members to be circulated, a sufficient strength is achieved and the endless belt can be prevented from being destructed.

Figure 21:
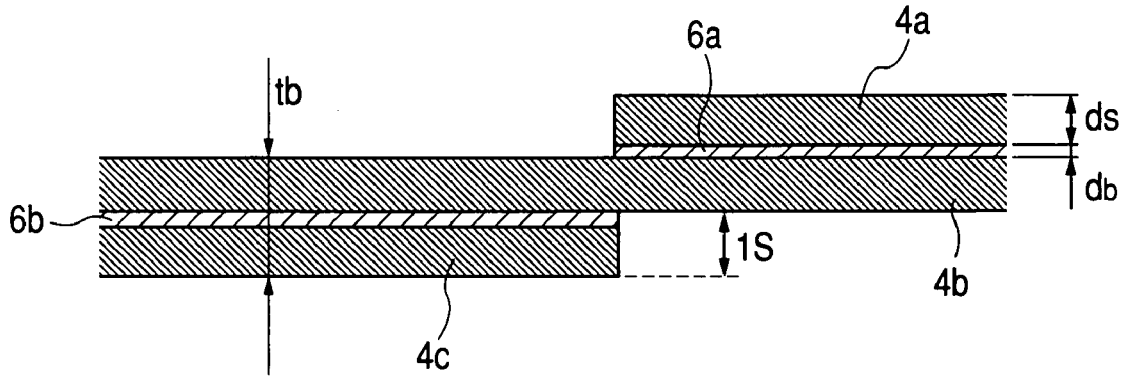
FIG. 21 is an enlarged view of a seam portion of the endless belt shown in FIG. 20.

FIG. 21 is an enlarged view of the seam portion of the endless belt 1. In this figure, notations 6*a* and 6*b* designate an adhering layer. When a thickness of the substrate is designated by notation ds and a thickness of the adhering layer is designated by db, a thickness tb of the belt and a stepped difference ls are expressed as follows.

$$tb=2ds+db \quad (1)$$

$$ls=ds+db \quad (2)$$

Figure 22:
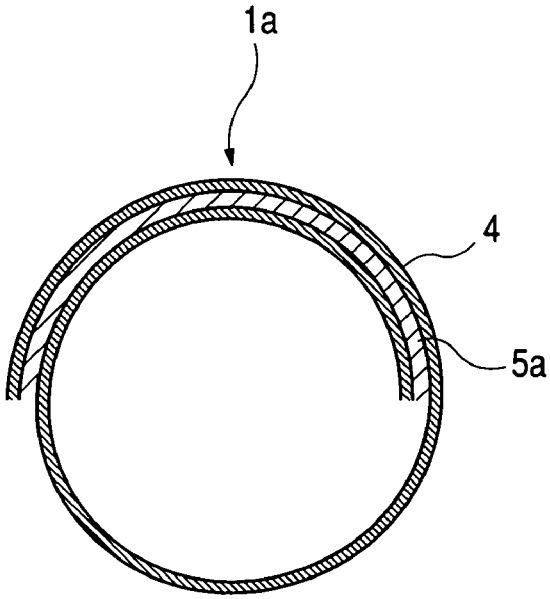
FIG. 22 is a schematic section view showing an endless belt of a comparative example.

FIG. 22 shows a comparative example in which a seam portion is shorter than an amount of a circumference of the endless belt. In this figure, an endless belt 1*a* is formed with a seam portion 5*a* shorter than a circumference thereof. A hatched portion designates an adhering layer of the seam portion 5*a*.

Figure 23:
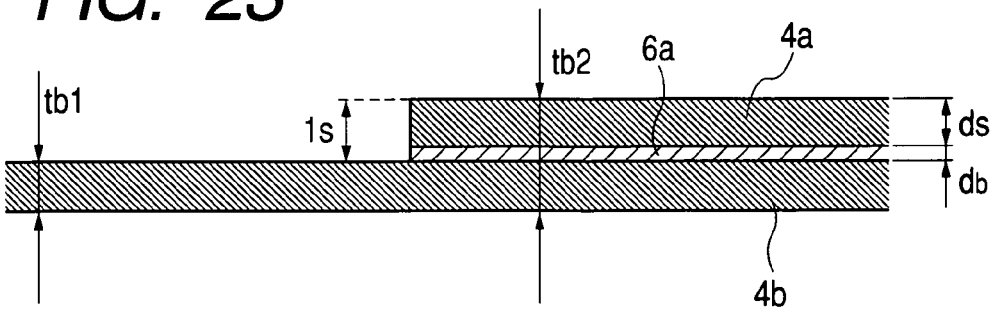
FIG. 23 is an enlarged view of a seam portion of the endless belt shown in FIG. 22.

FIG. 23 is an enlarged view of the seam portion 5*a* of FIG. 22. In this figure, notations 4*a* and 4*b* designate a substrate at an overlapped portion and notation 6*a* designates an adhering layer. When a thickness of the substrate 4*a* is designated by notation ds and a thickness of the adhering layer 6*a* is designated by notation db, a thickness of an endless belt is provided with two levels. When the belt thickness of the seam portion at a thin level is designated by notation tb1, the belt thickness of the seam portion at a thick level is designated by notation tb2 and a stepped difference is designated by notation ls, the following equations are established.

$$tb1=ds \quad (3)$$

$$tb2=2ds+db \quad (4)$$

$$ls=ds+db \quad (5)$$

Here, when the endless belt is used by being stretched between stretching members to drive to circulate, the belt member needs to be provided with a predetermined thickness or more in order to achieve a desired strength. When the belt member is provided with the desired strength or less, a time period of use (service life) until the belt member is cracked or broken is shortened.

Figure 24:
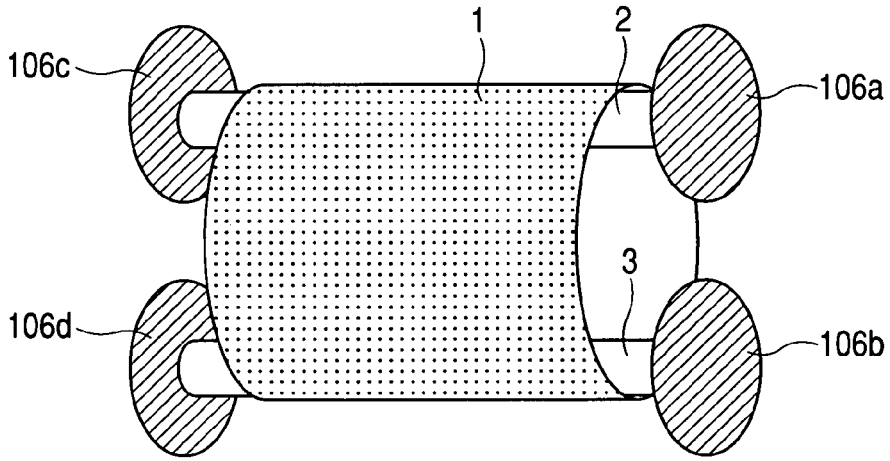
FIG. 24 is an explanatory view showing a state that the endless belt of FIG. 20 is stretched.

FIG. 24 is an explanatory view showing an example of using the endless belt. The endless belt 1 is stretched between stretching members 2 and 3. Further, notations 106*a* through 106*d* designate butting members provided at end portions of the respective stretching members 2 and 3 in order to prevent the endless belt 1 from shifting to one end. In the case of the example of FIG. 24, when the strength of the endless belt 1 is equal to or less than the desired strength, there is brought about a drawback that an end portion of the endless belt 1 is butted to the butting members 106*a* through 106*d* to buckle, wrinkle or the like.

Now, when a predetermined thickness tb of the endless belt is made to be equal to or larger than 300 μm and the thickness db of the adhering layer is made to be 1 μm, the thickness ds of the substrate becomes as follows from Equation (1), $$ds>149.5\ \mu m$$

and the thickness of the substrate needs to be equal to or larger than 149.5 μm.

Meanwhile, from Equations (3) and (4), in the case of the belt having the constitution of FIG. 23, a relationship between the thickness tb1 of the endless belt and the thickness tb2 of the endless belt at the seam portion becomes as follows, $$tb2>tb1=ds>300\ \mu m$$

and the thickness of the substrate needs to be equal to or larger than 300 μm.

In this embodiment, from Equation (2), each stepped difference becomes as follows.

$$ls=ds+db=149.5\ \mu m+1\ \mu m=150.5\ \mu m$$

In contrast thereto, according to the constitution of FIG. 23, from Equation (5), each stepped difference becomes as follows.

$$ls=ds+db=300\ \mu m+1\ \mu m=301\ \mu m$$

Therefore, according to the constitution of the invention, in comparison with the example in FIG. 23, the stepped difference can be reduced with regard to the predetermined belt thickness in order to achieve a necessary strength.

When the necessary strength of the belt is designated by notation x(μm) in order to expand the above-described explanation to general theory, the following equations are established as follows. From Equations (1) and (2), $$ds>(x-db)/2 \quad (6)$$

$$ls>(x-db)/2+db(x+db)/2 \quad (7)$$

Meanwhile, from Equations (3) and (4), $$tb2>tb1=ds>x \quad (8)$$

From Equation (5), $$ls>x+db \quad (9)$$

Therefore, when the necessary thickness of the sheet substrate is made to be equal to or larger than x(μm), each stepped difference becomes (x+db)/2 (μm) in this embodiment, and becomes equal to or larger than x+db(μm) in the case of the comparative example. Therefore, according to this embodiment, the thickness of the stepped difference can be halved.

Figure 25:
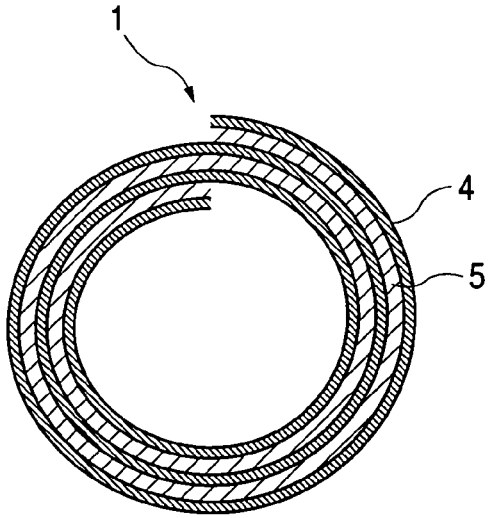
FIG. 25 is a schematic section view showing an endless belt according to a seventh embodiment of the invention.

FIG. 25 shows an endless belt according to a seventh embodiment of the invention in which the stepped difference is further reduced. In this embodiment an endless belt 1 is formed by wounding the substrate 4 with a plurality of turns. Therefore, a plurality of layers of the seam portion 5 are formed between the substrates 4.

Generally, when an endless belt wound with a circumference thereof by n times is constituted (n=2 in the example of FIG. 20), the thickness tb and the thickness is of the stepped difference of the endless belt become as follows.

$$tb=nds+(n-1)db \quad (10)$$

$$ls=ds+db \quad (11)$$

When the necessary thickness of the substrate is made to be equal to or larger than x(μm), the following is established from Equation (10).

$$ds>[x-(n-1)db]/n \quad (12)$$

Further, from Equation (11), the following is established.

$$ls>[x-(n-1)db]/n+db=(x+db)/n \quad (13)$$

By comparing with Equation (9), the stepped difference of the endless belt of this embodiment can be made to be 1/n of that of the endless belt having the constitution of FIG. 23.

Figure 20:
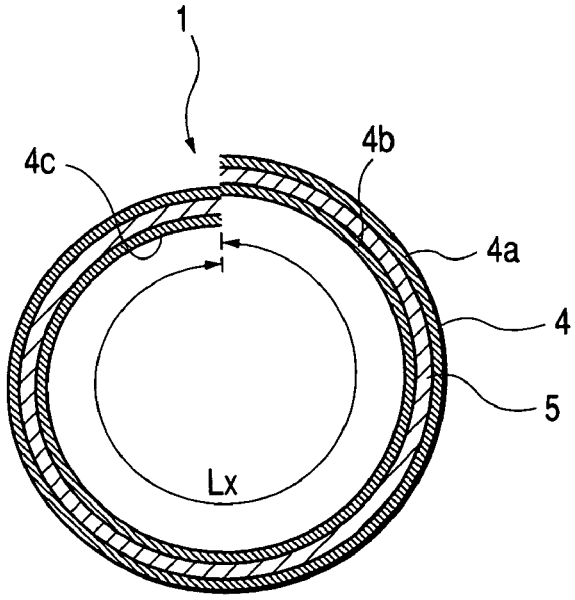
FIG. 20 is a schematic section view showing an endless belt according to a sixth embodiment of the invention.
Figure 26:
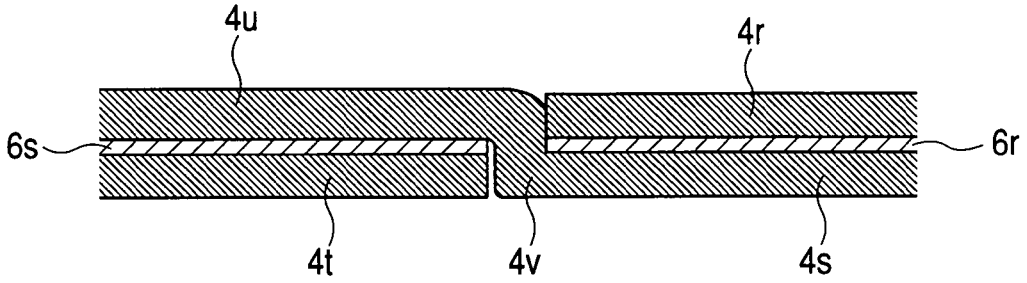
FIG. 26 is an enlarged view of a seam portion of an endless belt according to an eighth embodiment of the invention.

FIG. 26 shows an endless belt according to an eighth embodiment of the invention in which the stepped difference of the endless belt of FIG. 20 is further reduced. In this figure, notations 4*t* and 4*r* designate both longitudinal end portions of the substrate 4, notations 4*s* and 4*u* designate wound portions of the substrate 4 and notation 4*v* designates a stepped portion. Also, in this figure, notations 6*r* and 6*s* designate an adhering layer.

In this embodiment, the stepped difference is reduced by arranging the both longitudinal end portions 4*t* and 4*r* to be opposed to each other through the stepped portion 4*v*, and flattening the stepped portion 4*v* by thermal pressing in the thickness direction thereof. Therefore, the stepped difference is reduced without entirely pressing the seam portion. When the belt is used as a fixing film, since temperature transfer to a recording medium is not reduced, a failure in fixing can be prevented from being brought about. Further, the stepped difference can be reduced to be ⅓ of the stepped difference of the case where the substrate is wound by three times as in FIG. 25.

A photosensitive film of the sixth embodiment can be obtained by the same way as described in connection with the first embodiment. Only the different matters will be described below.

As a substrate, a film of polyester resin having a predetermined thickness, a width of 340 mm and a length of 377 mm.

The photosensitive film is coated with an adhering agent (406; Loctite Corporation) over an entire face thereof while leaving a length of 188 mm and wound to adhere as shown by FIG. 20. Further, the charge transporting layer is disposed on an outer side of the seamed endless belt. A diameter of the formed seamed endless belt photosensitive member is ϕ60 mm.

Further, as a comparative example, a conductive layer, an under coating layer, a charge generating layer and a charge transporting layer are similarly formed at a film of polyester resin having a predetermined thickness, a width of 340 mm and a length of 243 mm and wound to adhere as shown by FIG. 22 to thereby form a photosensitive film. A width of a seam portion is 55 mm and a diameter of a belt photosensitive member is ϕ60 mm.

Next, an explanation will be given of a relationship among the thickness, and the strength of the substrate and the image quality. Continuous printing of ten thousands sheets is carried out by the image forming apparatus shown in FIG. 9 by changing the thickness of a polyester rein film which is the substrate. With regard to the strength of the substrate, it is investigated whether a damage of crack, break, buckle by one side shifting or the like is brought about at the belt member. In evaluating, the image forming apparatus is stopped at each continuous printing of 500 sheets and eye observation is carried out by opening a lid of the apparatus. With regard to the image quality, a solid image of gray is printed by A4 size and eye observation is carried out with respect to several sheets of printing at an initial stage on whether a nonuniformity of image caused by the stepped difference of the seam portion (black streak, white depletion, gross streak) or the like is brought about.

Table 6 shows experimental results of the above evaluation. It is found that although there is a region excellent in the strength and the image quality in the embodiment, while the region is not present in the comparative example.

TABLE 6

| substrate thickness (μm) | stepped difference (μm) | belt thickness (μm) | strength | image quality |
|---|---|---|---|---|
| | | Embodiment 6 | | |
| 20 | 65 | 129 | cracked | good |
| 25 | 70 | 139 | buckled | good |
| 30 | 75 | 149 | buckled | good |
| 35 | 80 | 159 | good | good |
| 40 | 85 | 169 | good | good |
| 45 | 90 | 179 | good | no good |
| 50 | 95 | 189 | good | no good |
| | | Comparative Example | | |
| 20 | 65 | 64 | cracked | good |
| 25 | 70 | 69 | broken | good |
| 30 | 75 | 74 | broken | good |
| 35 | 80 | 79 | cracked | good |
| 40 | 85 | 84 | cracked | good |
| 45 | 90 | 89 | buckled | no good |
| 50 | 95 | 94 | buckled | no good |

The endless belt according to the seventh embodiment can be obtained as follows. A photosensitive film is formed by forming a conductive layer, an under coating layer, a charge generating layer and a charge transporting layer above a film of polyester resin having a predetermined thickness, a width of 340 mm and a length of 565 mm similar to the above-described. The photosensitive film is coated with an adhering agent (406; Loctite Corporation) over an entire face thereof while leaving a length of 188 mm and wound as shown by FIG. 25 to adhere. Further, the charge transporting layer is disposed on an outer side of the seamed endless belt.

Ten thousands sheets of continuous printing is carried out by the image forming apparatus shown in FIG. 9 by changing the thickness of the polyester resin film constituting the substrate. With regard to the strength of the substrate, it is investigated whether the damage of crack, break, buckling due to one side shifting or the like is brought about at the belt member. In evaluating, the image forming apparatus is stopped at each continuous printing of 500 sheets and eye observation is carried out by opening the lid of the apparatus.

With regard to the image quality, a solid image of gray of A4 size is printed and eye observation is carried out with respect to several sheets for printing at an initial stage on whether image nonuniformity caused by the stepped difference of the seam portion (black streak, white depletion, gross streak) or the like is brought about.

Table 7 shows experimental results of the above evaluation. When embodiments of Table 7 and Table 6 are compared, it is found that the region excellent in the strength and the image quality can be widened in the case of the substrate wound by a number of turns.

TABLE 7

| substrate thickness (μm) | stepped difference (μm) | belt thickness (μm) | strength | image quality |
|---|---|---|---|---|
| | | Embodiment 7 | | |
| 20 | 65 | 194 | good | good |
| 25 | 70 | 209 | good | good |
| 30 | 75 | 224 | good | good |
| 35 | 80 | 239 | good | good |
| 40 | 85 | 254 | good | good |
| 45 | 90 | 269 | good | no good |
| 50 | 95 | 284 | good | no good |

The endless belt according to the eighth embodiment can be obtained as follows. A photosensitive film is formed by forming a conductive layer, an under coating layer, a charge generating layer and a charge transporting layer above a film of polyester resin having a predetermined thickness, a width of 340 mm and a length of 377 mm similar to the above-described. The photosensitive film is coated with an adhering agent (406; Loctite Corporation) over an entire face thereof while leaving a length of 188 mm and wound as shown by FIG. 20 and adhered by separating the longitudinal end portions thereof by about 100 μm. In this case, the charging transporting layer is arranged to be disposed on the outer side of the belt.

Next the separated portion is mounted on a hot plate, placed with a flat plate from above, applied with a total load of 60 kg and heated for 30 minutes at 180° C. When the selection after processing was observed by a microscope, the section was as shown by FIG. 26.

Ten thousand sheets of continuous printing is carried out by the image forming apparatus shown in FIG. 9 by changing the thickness of the polyester rein film constituting the substrate. With regard to the strength of the substrate, it is invested whether a damage of crack, break, buckle by one side shifting or the like is brought about at the belt member. In evaluating, the image forming apparatus is stopped at each 500 sheets of continuous printing and eye observation is carried out by opening the lid of the apparatus.

TABLE 8

| Embodiment 8 | | | | |
|---|---|---|---|---|
| substrate thickness (μm) | stepped difference (μm) | belt thickness (μm) | strength | image quality |
| 20 | 1.3 | 129 | cracked | good |
| 25 | 2.1 | 139 | buckled | good |
| 30 | 2.5 | 149 | buckled | good |
| 35 | 3.0 | 159 | good | good |
| 40 | 5.0 | 169 | good | good |
| 45 | 8.8 | 179 | good | no good |
| 50 | 10.1 | 189 | good | no good |

With regard to the image quality, eye observation is carried out with respect to several sheets of printing at an initial stage on whether image nonuniformity caused by the stepped difference of the seam portion (black streak, white depletion, gross steak) or the like is brought about. Table 8 shows experimental results the evaluation. When Table 8 is compared with Table 6, it is found that the region excellent in the strength and the image quality in the eighth embodiment is widened in comparison with the sixth embodiment.

As a ninth embodiment, an explanation will be given of an example in which an endless belt of the invention is used as an intermediate transfer belt in an image forming apparatus. The endless belt can be obtained by almost the same way as described in connection with the second embodiment. Only the different matters will be described below.

As a substrate, there is used a conducive resin film having a thickness of 80 μm, a width of 340 mm and a length of 2512 mm.

The film is coated with an adhering agent (1521; Three Bond Co., Ltd) while leaving a length of 628 mm, wound by a plurality of turns as shown by FIG. 25 or wound by an amount of a total of four circumferences to adhere. Otherwise, the film may be melted to adhere by heat and pressure. A diameter of the formed seamed endless intermediate transfer belt is ϕ200 mm.

Figure 32:
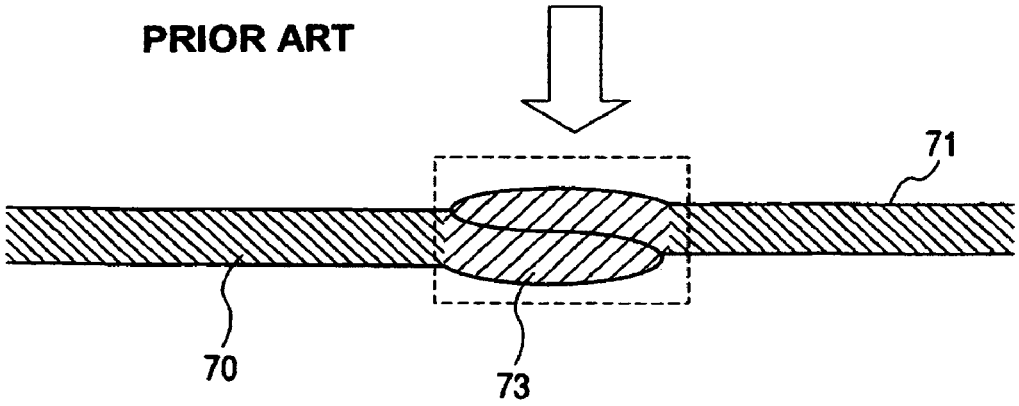
FIG. 32 is an explanatory view showing a condition that heat and pressure are applied to the seam portion shown in FIG. 31.

A comparative example is formed as follows: i) As a substrate, a conductive resin film (dispersed with 20 wt % of carbon black powder as a conductive agent in polyurethane resin) having a thickness of 300 μm, a width of 340 mm and a length of 975 mm is used; ii) The film is formed with an overlapped portion in which both longitudinal end portions are overlapped (see FIG. 22). The overlapped portion is mounted on a hot plate, placed with a flat plate from above, applied with a total load of 60 kg and heated for 30 minutes at 290° C.; iii) When the section after processing was observed, the film was as shown by FIG. 32; iv) A length of a seam portion is 347 mm and a diameter of the formed seamed endless intermediate transfer belt is ϕ200 mm.

Next, an explanation will be given of evaluating an image quality concerning a surrounding environment when the intermediate transfer belt is used. Printing carried out by the image forming apparatus shown in FIG. 12 with regard to three levels of the surrounding environment of LL (10° C., 15% humidity), NN (25° C., 60% humidity) and HH (35° C., 65% humidity).

TABLE 9

| | substrate thickness (μm) | stepped difference (μm) | belt thickness (μm) | image quality LL | NN | HH |
|---|---|---|---|---|---|---|
| Embodiment 9 | 80 | 81 | 323 | good | good | good |
| Comparative Example | 300 | 10 | 300 | no good | good | no good |

10 sheets of A3 size of an image of a solid image of gray of only magenta are continuously printed and eye observation is carried out on whether a nonuniformity in image (nonuniformity in density, black streak, white depletion, gross streak) caused by the seam portion is brought about. Further, when the belt thickness is made to be equal to or larger than 300 μm, there is not a damage of buckling or crack or the like and the belt strength was guaranteed. Further, since it had already been known that when the stepped difference was made to be equal to or smaller than 90 μm, a nonuniformity in an image by the stepped difference is not brought about, an experimental data thereof will be omitted. Table 9 shows experimental results of the evaluation.

It seems that occurrence of a nonuniformity in the image density (the no good result) in the comparative example is caused by a resistance of the intermediate transfer belt. Thus, the resistance of the intermediate transfer belt is measured under a condition of constant voltage of 250V by using a high resistance measuring apparatus (Hiresta; Mitsubishi Chemical Corporation). Table 10 shows the experimental results.

TABLE 10

| | resistance, log R (Ω) LL | NN | HH |
|---|---|---|---|
| Embodiment 9 | 9.6 | 8.7 | 8.0 |
| Comparative Example (seam portion) | 10 | 9.1 | 8.1 |
| Comparative Example (other than seam portion) | 9.5 | 8.8 | 7.8 |

It is found that the resistance of the seam portion becomes larger than that of the other portion. When the belt of the Comparative example is formed, since the seam portion is compressed by heat and pressure, the density at the portion is increased and the resistance value is also increased. Further, in the environment of increasing the resistance value of the LL environment, it seems that the resistance of the seam portion exceeds an upper limit value and voltage drop is increased, so that the transferring efficiency is reduced and an amount of the toner to be transferred is reduced.

Conversely, since the resistance value is small at other than the seam portion, and the resistance value at other than the seam portion becomes less than a lower limit value in the environment of reducing the resistance value of the HH environment. As a result, it seems that discharge due to extra transfer bias is generated at other than the seam portion and scattering of the toner (no good result) is brought about. Therefore, it is found that the embodiment is easier to confine the resistance value of the intermediate transfer belt in an excellent region than the comparative example.

As a tenth embodiment, an explanation will be given of an example in which an endless belt of the invention is used as a fixing belt in an image forming apparatus. The endless belt can be obtained by almost the same way as described in connection with the third embodiment. Only the different matters will be described below.

As a substrate, a polyimide film having a thickness of 70 μm, a width of 340 mm and a length of 292 mm is used.

The film is coated with an adhering agent (KS9100; Hitachi Chemical Co., Ltd.) over an entire face thereof while leaving a length of 97 mm and wound by a plurality of turns as shown by FIG. 25 to adhere. Otherwise, the film may be melted to adhere by heat and pressure. A diameter of the formed fixing belt is ϕ31 mm.

A comparative example is formed as follows: i) As a substrate, a polyimide film having a thickness of 20 μm, a width of 340 mm and a length of 107 mm is used; ii) The film is formed with an overlapped portion in which both longitudinal end portions are overlapped (see FIG. 22). The overlapped portion is mounted on a hot plate, placed with a flat plate from above, applied with a total load of 80 kg and heated for 30 minutes at 290° C.; iii) when the section after processing was observed by a microscope, the film was as shown by FIG. 32; iv) A length of the seam portion is 9 mm and a diameter of the formed fixing belt is ϕ31 mm.

Printing is carried out by the image forming apparatus shown in FIG. 18 and the image quality is evaluated. With regard to an image, 10 sheets of A3 size of a solid image of gray only of magenta are continuously printed and eye observation is carried out on whether a nonuniformity in image (nonuniformity in density, black streak, white depletion, gross streak) caused by the seam portion is brought about. Further, also fixing strength of a portion in correspondence with a seam portion of the image and a portion which is not in correspondence therewith are examined.

There is taken a ratio of densities before and after rubbing by a sand matrix eraser rubber (GAZA; Lion Office Products Corp.). The ratio is defined as a fixing rate and a fixing rate less than 0.75 is defined as a failure in fixing. Further, since it had already been known that there was not buckling, crack or the like and the belt strength was guaranteed in a case where the belt thickness was equal to or larger than 200 μm. Further, when the stepped difference was made to be equal or smaller than 90 μm, a nonuniformity in image by the stepped difference was not brought about, experimental data in such conditions will be omitted. Table 11 shows experimental results of the above evaluation.

A failure in fixing was brought about at a portion in correspondence with the seam portion of the belt of the comparative example. The fixing rate is 0.4 through 0.6. In order to investigate the cause, in the image forming apparatus of FIG. 18, a surface of the belt at a vicinity of a sheet discharging port is measured by a radiation pyrometer (THI-700S; Tasco Japan Inc.). Temperature drop of 20° C. through 40° C. was measured in correspondence with the seam portion when paper passes the fixing unit.

TABLE 11

| | substrate thickness (μm) | stepped difference (μm) | belt thickness (μm) | image quality |
|---|---|---|---|---|
| Embodiment 10 | 70 | 71 | 212 | good |
| Comparative Example | 200 | 18 | 200 | fixing failure at portion corresponding to seam portion |

Upon evaluation of the image quality in Table 11, temperature conductivity "a" (m/sec) is defined as follows:

$$a=\lambda/(\rho\cdot c) \tag{14}$$

where density of substance: ρ (kg/m$^3$), specific heat: c (J/(kg·° C.)) and heat conductivity: λ (W/(m·° C.)) (see page 7 of "Heat Transfer Engineering" Ichimatsu Tanishita, Shokabo).

Figure 27:
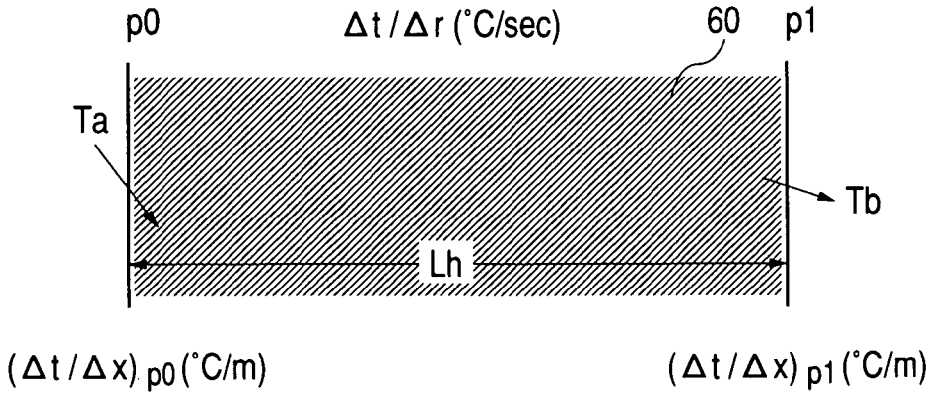
FIG. 27 is a diagram for explaining thermal conductivity in substance.

FIG. 27 is a diagram for explaining the temperature conductivity of substance. In this figure, numeral 60 designates a substance, notation Ta designates absorbing temperature and notation Tb designates radiation temperature. With regard to Equation (14), consider boundaries p0 and p1 having a length therebetween Lh, for example, a distance of 1 m at inside of the substance 60. In this case, in the case in which a temperature rise rate of a hatched portion between the boundaries is Δt/Δτ (° C./sec), when a temperature gradient at the boundary p0 is defined as $(\Delta t/\Delta x)_{p0}$ (° C./m) and a temperature gradient at the boundary p1 is defined as $(\Delta t/\Delta x)_{p1}$ (° C./m), the following equation is established.

$$(\Delta t/\Delta x)_{p1}-(\Delta t/\Delta x)_{p0}=(1/a)(\Delta t/\Delta\tau) \tag{15}$$

From Equation (15), the more increased is the temperature conductivity "a", the smaller the difference between the temperature gradients of the boundaries p0 and p1. That is, the smaller the temperature difference between the boundaries p0 and p1. Therefore, the larger the temperature conductivity, the faster the temperature transfer of the substance. Further, in the case of forming a sheet by the substance, when a rear side of the sheet is heated, the heat immediately reaches a front side of the sheet and the temperature difference between the both sides of the sheet can almost be nullified.

Here, from Equation (14), the temperature conductivity a is inversely proportional to the density ρ of the substance. At the seam portion of the fixing plate of the comparative example, since the seam portion is compressed by heat and pressure, the density at the portion is increased. When the seam portion was cut out and the density was measured (calculated by measuring dimensions and weight), the density becomes 1.9 times as large as that of a portion other than the seam portion. It seems that the temperature conductivity of the seam portion becomes about a half or more of that of the other portion.

Figure 28:
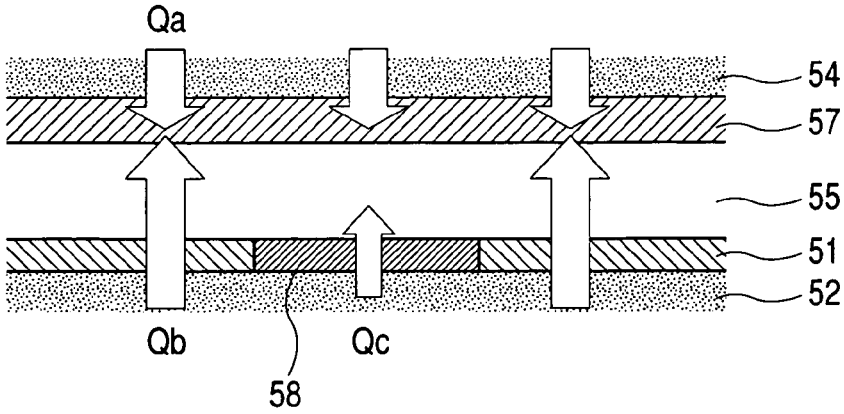
FIG. 28 is an enlarged view of a nip portion in the fixing unit shown in FIG. 15.

Next, an explanation will be given of a mechanism of bringing about a failure in fixing when the temperature conductivity is small. FIG. 28 shows an enlarged view of a nip portion of the fixing unit of FIG. 15. Immediately before fixing recording paper, the heating member 54 is maintained at desired temperature by the heat generator H of FIG. 15. At the same time, by driving to rotate the fixing belt 51 by the drive stretching member 52 when paper is not passed, the fixing belt 51 is heated via the nip and maintained at the desire temperature.

Also temperatures of the drive stretching member 52 and the stretching member 53 stretching the fixing belt 51 become higher than room temperature. Under this condition, the recording paper 55 is carried in an arrow J direction of FIG. 15 and advances into the nip portion. In FIG. 28, numeral 57 designates a toner layer. At this occasion, since temperatures of the toner layer 57 and the recording paper 55 are lower than that of the heating member 54, heat is conducted from the heating member 54 to the toner layer 57 in an arrow Qa direction.

At the same time, heat is transmitted also from the fixing belt 51 and the drive stretching member 52 to the toner layer 57 via the recording paper 55 from an arrow Qb direction. At this occasion, in the case of the fixing belt of the comparative example, since the seam portion is formed with a high density portion 58 and the temperature conductivity of the high density portion 58 is low, heat Qc conducted from the drive stretching member becomes lower than the heat Qb at a portion other than the seam portion. Therefore, a heat transfer amount of the seam portion becomes deficient, so that a sufficient amount of the toner layer cannot be melted and the failure in fixing is brought about.

As an eleventh embodiment, there will be explained an example in which an endless belt of the eighth embodiment is used in a fixing unit 50*b* shown in FIG. 29.

As the driving member 52, silicone foam having a wall thickness of 6 mm is provided by a length of 360 mm on a shaft 52*a* made of stainless steel having a length of 397 mm and a diameter of ϕ23 mm and a PFA tube having a wall thickness of 30 μm is covered further thereon to form an outer side layer 52*b*.

There is used a supporting member 54*x* made of PTFE resin in a shape of a circular arc having an outer radius of curvature of 31 mm, a wall thickness of 4 mm and a length of 360 mm. Further, a portion thereof in contact with the driving member 52 is formed with a flat face 54*y*. The supporting member 54*x* uses an electric heater of 1050 W as the heat generator H and is arranged to be opposed to the driving member 52 via the fixing belt 51. The heat generator H is provided at inside of the supporting member 54. The driving member 52 and the supporting member 54*x* are pressed by a total load of 16 kg. Notation M designates a rotational direction of the driving member 52 and notation N designates a rotational direction of the fixing belt 51.

The fixing unit 50*b* of this embodiment is installed in place of the fixing unit 50*a* of the image forming apparatus shown in FIG. 18. Here, circulation speed of the fixing belt 51 is set to 250 mm/sec in surface speed, paper passing speed is set to 10 ppm for A4 paper passed transversely and fixing temperature is set to 190° C.

Printing was carried out in this condition and image quality was evaluated. As an image, 10 sheets of A3 size of a solid image of gray only of magenta were continuously printed and eye observation was carried out on whether a nonuniformity of image caused by the seam portion (nonuniformity of density, black streak, white depletion, gross streak) or the like was brought about.

Further, fixing strengths of a portion of the image in correspondence with the seam portion and other portion were also examined. A ratio of densities before and after rubbing by a sand matrix eraser rubber (GAZA; Lion Office Products Corp.) was sampled. The ratio was defined as a fixing rate and a rate less than 0.75 was defined as a failure in fixing. Further, it had already been known that there was not buckling, crack or the like and the belt strength was guaranteed in a case where the belt thickness was made to be equal to or larger than 200 μm. Further, a nonuniformity in image by the stepped difference was not brought about when the stepped different was made to be equal to or smaller than 90 μm. Therefore, experimental data in such conditions are omitted. Table 12 shows experimental results of the above evaluation. The comparative example was the same as shown in Table 11.

As shown, low temperature offset was brought about at a portion of the belt in correspondence with the seam portion of the comparative example. The low temperature offset is a phenomenon in which the toner is not melted at all but exfoliated from above paper and adhered to a surface layer of the fixing belt. Further, a temperature of a surface of the belt at a vicinity of a paper discharge outlet is measured by a radiation pyrometer (THI-700S; Tasco Japan Inc.) Temperature drop of 60° C. through 100° C. is measured in correspondence with the seam portion when paper passes the fixing unit.

TABLE 12

| | substrate thickness (μm) | stepped difference (μm) | belt thickness (μm) | image quality |
|---|---|---|---|---|
| Embodiment 11 | 70 | 71 | 212 | good |
| Comparative Example | 200 | 18 | 200 | low temperature offset at portion corresponding to seam portion |

Figure 29:
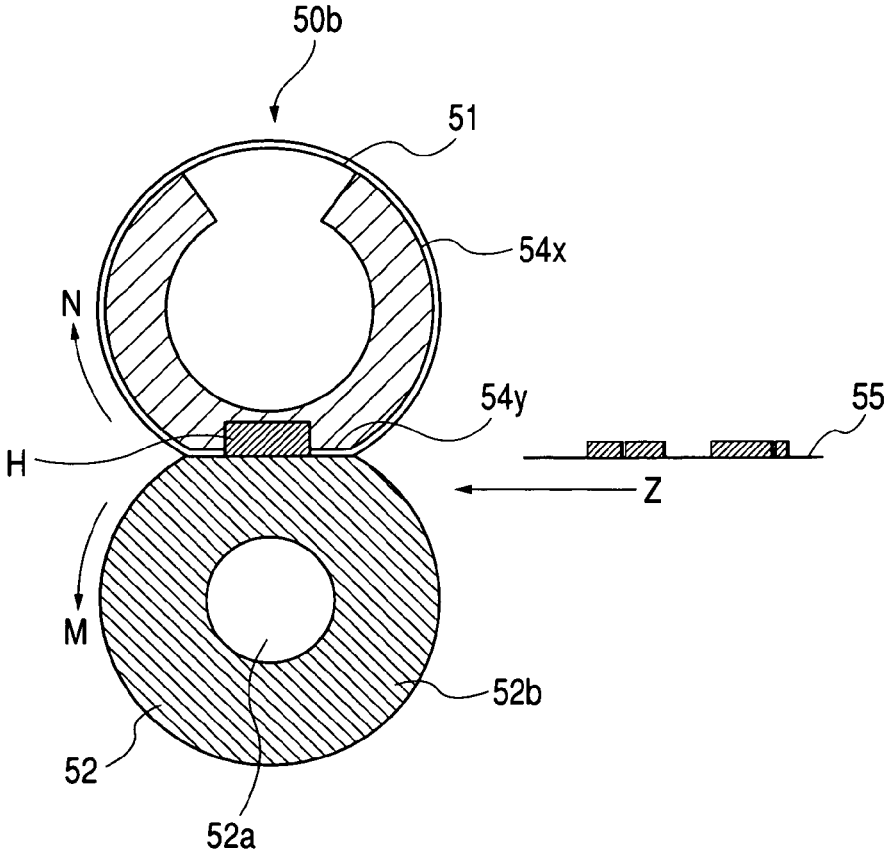
FIG. 29 is an explanatory view showing a fixing unit incorporating the endless belt of the eighth embodiment.
Figure 30:
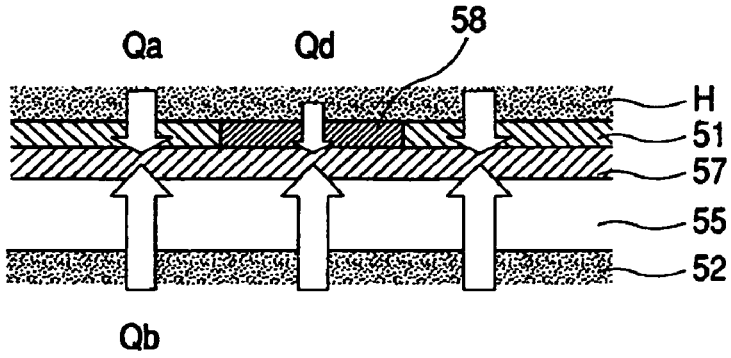
FIG. 30 is an enlarged view of a nip portion in the fixing unit shown in FIG. 29.
Figure 31:
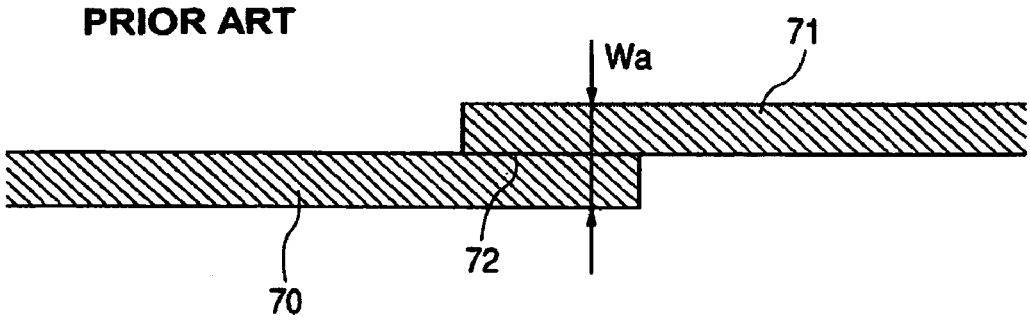
FIG. 31 is an explanatory view showing a seam portion of a conventional endless belt.

FIG. 30 is an enlarged view of a nip portion of the fixing unit of FIG. 29. Immediately before fixing the recording paper 55, the fixing belt 51 is maintained at desired temperature by the heat generator H. At the same time, by driving to rotate the fixing belt 51 by the driving member 52 when paper is not passed, the driving member 52 is heated via the nip and is maintained at the desired temperature. Under the state, the recording paper 55 is carried in an arrow Z direction of FIG. 29 and advances into the nip portion to bring about a state shown in FIG. 30.

In this case, since temperatures of the toner layer 57 and the recording paper 55 are lower than that of the heat generator H, heat is transferred from the heat generator H to the toner layer 57 via the fixing belt 51 in the arrow Qa direction. At the same time, heat is also transferred from the driving member 52 to the toner layer 57 via the recording paper 55. In the case of the comparative example, the high density portion 58 is formed at the seam portion of the fixing belt 51, since the temperature conductivity of the high density portion 58 is low, heat Qd transmitted from the heat generator becomes smaller than the heat Qa at a portion other than the seam portion.

Therefore, even when the fixing unit is constituted as shown by FIG. 29, according to the comparative example, a heat transfer amount of the seam portion becomes deficient so that the toner layer 57 cannot be melted to bring about the low temperature offset. In this case, the temperature drop at the seam portion is more significant in the case of conducting heat from the fixing belt 51 to the toner layer 57 as shown by FIG. 30 than the temperature drop in a case where heat is transferred from the fixing belt 51 to the toner layer 57 via the recording paper 55, as explained in reference to FIG. 28.

The reason is that according to the example of FIG. 30, a rate of temperature contributing to melt the toner is larger in the case of temperature of the fixing belt 51 in contact with the toner layer 57 than in the case of temperature of the driving member 52 in contact with the recording paper 55. With regard to melting of the toner, the contributing rate of heat transfer from the driving member 52 in contact with the recording paper 55 is about a half through a third of the contributing rate of heat transfer from the fixing belt 51 in contact with the toner layer 57. Therefore, when the fixing belt by the endless belt of the invention is used for the fixing unit as shown by FIG. 29, the effect is considerable in view of preventing the low temperature offset.

In this case, the intermediate transfer belt 23 shown in FIG. 18 may be constituted similarly to the fixing belt shown in FIG. 20 or FIG. 26.

Although the four-cycle color image forming apparatus using the developing rotary is shown in some of the above embodiments, the invention is applicable to a tandem-type color image forming apparatus. Further, the invention is applicable also to a fixing device of an image forming apparatus having a photosensitive drum as an image carrier. In this way, the invention is widely applicable to an image forming apparatus having an image carrier for transferring an image onto a recording medium.

What is claimed is:

1. A belt member, comprising a seam portion formed by overlapping and adhering both longitudinal end portions thereof to constitute an endless belt stretched and circulated by a rotative, first stretching member and a second stretching member, wherein a length of the seam portion is no less than a length between a first point at which the endless belt is separated from one of the first stretching member and the second stretching member and a second point at which the endless belt is brought into contact with the other one of the first stretching member and the second stretching member.

2. An image forming apparatus, comprising:

the belt member as set forth in claim 1;

a photosensitive member, operable to support a toner image thereon; and a transfer member, operable to transfer the toner image from the photosensitive member onto a recording medium transported by the belt member.

3. An image forming apparatus, comprising:

the belt member as set forth in claim 1;

a photosensitive member, operable to support a toner image thereon;

a primary transfer device, operable to transfer a toner image from the photosensitive member onto the belt member; and a secondary transfer device, operable to transfer the toner image from the belt member onto a recoding medium.

4. The image forming apparatus as set forth in claim 3, further comprising a third stretching member and fourth stretching member which are arranged such that a circulating path of the belt member is made trapezoidal.

5. An image forming apparatus, comprising:

the belt member as set forth in claim 1;

a heat generator, provided with the first stretching member; and a fixing member, arranged so as to abut against the first stretching member through the belt member, so that a toner image formed on a recording medium is fixed thereon when the recording medium is placed at a nip portion between the fixing member and the belt member.

6. The image forming apparatus as set forth in claim 5, further comprising:

a photo sensitive member, operable to support a toner image thereon; and a transfer member, operable to transfer the toner image from the photosensitive member onto a recording medium which is to be transported to the nip position.

7. The image forming apparatus as set forth in claim 5, further comprising:

a photosensitive member, operable to support a toner image thereon;

an intermediate transfer member;

a primary transfer device, operable to transfer a toner image from the photosensitive member onto the intermediate transfer member; and a secondary transfer device, operable to transfer the toner image from the intermediate transfer member onto a recoding medium which is to be transported to the nip portion.

8. An image forming apparatus, comprising:

the belt member as set forth in claim 1; and a fixing member, provided with a heat generator and arranged so as to abut against the first stretching member through the belt member, so that a toner image formed on a recording medium is fixed thereon when the recording medium is placed at a nip portion between the fixing member and the belt member.

9. The image forming apparatus as set forth in claim 8, further comprising:

a photo sensitive member, operable to support a toner image thereon; and a transfer member, operable to transfer the toner image from the photosensitive member onto a recording medium which is to be transported to the nip position.

10. The image forming apparatus as set forth in claim 8, further comprising:

a photosensitive member, operable to support a toner image thereon;

an intermediate transfer member;

a primary transfer device, operable to transfer a toner image from the photosensitive member onto the intermediate transfer member; and a secondary transfer device, operable to transfer the toner image from the intermediate transfer member onto a recoding medium which is to be transported to the nip portion.

11. The image forming apparatus as set forth in claim 8, wherein the second stretching member has a semiannular shape.

12. The belt member as set forth in claim 1, wherein the belt member is wound by a plurality of turns so that the length of the seam portion is made no less than a circumference of the endless belt.

13. The belt member as set forth in claim 12, wherein the belt member is formed with a stepped portion through which both longitudinal ends of the belt member oppose to each other in a circumferential direction of the endless belt.

14. An image forming apparatus, comprising:

a rotative, first stretching member;

a second stretching member;

a belt member, comprising a seam portion formed by overlapping and adhering both longitudinal end portions thereof to constitute an endless belt stretched and circulated by the first stretching member and the second stretching member;

a fixing member, provided with a heat generator and arranged so as to abut against the first stretching member and the second stretching member through the belt member, so that a toner image formed on a recording medium is fixed thereon when the recording medium is placed at a nip portion between the fixing member and the belt member;

wherein a length of the seam portion is no less than a length between a first point at which the fixing member is abutted against the first stretching member through the belt member and a second point at which the fixing member is abutted against the second stretching member through the belt member.

15. The image forming apparatus as set forth in claim 14, wherein the second stretching member has a semiannular shape.

16. The image forming apparatus as set forth in claim 14, further comprising:

a photo sensitive member, operable to support a toner image thereon; and a transfer member, operable to transfer the toner image from the photosensitive member onto a recording medium which is to be transported to the nip position.

17. The image forming apparatus as set forth in claim 14, further comprising:

a photosensitive member, operable to support a toner image thereon;

an intermediate transfer member;

a primary transfer device, operable to transfer a toner image from the photosensitive member onto the intermediate transfer member; and a secondary transfer device, operable to transfer the toner image from the intermediate transfer member onto a recoding medium which is to be transported to the nip portion.

* * * * *